US011022905B2

(12) United States Patent
Honda et al.

(10) Patent No.: US 11,022,905 B2
(45) Date of Patent: Jun. 1, 2021

(54) TONER BINDER AND TONER

(71) Applicant: SANYO CHEMICAL INDUSTRIES, LTD., Kyoto (JP)

(72) Inventors: Masaru Honda, Kyoto (JP); Seiji Odaka, Kyoto (JP); Daiki Kuroda, Kyoto (JP)

(73) Assignee: SANYO CHEMICAL INDUSTRIES, LTD., Kyoto (JP)

( * ) Notice: Subject to any disclaimer, the term of this patent is extended or adjusted under 35 U.S.C. 154(b) by 0 days.

(21) Appl. No.: 16/652,749

(22) PCT Filed: Sep. 10, 2018

(86) PCT No.: PCT/JP2018/033420
§ 371 (c)(1),
(2) Date: Apr. 1, 2020

(87) PCT Pub. No.: WO2019/073731
PCT Pub. Date: Apr. 18, 2019

(65) Prior Publication Data

US 2020/0233327 A1 Jul. 23, 2020

(30) Foreign Application Priority Data

Oct. 13, 2017 (JP) ..... JP2017-199263

(51) Int. Cl.
*G03G 9/08* (2006.01)
*G03G 9/087* (2006.01)

(52) U.S. Cl.
CPC ..... *G03G 9/08755* (2013.01); *G03G 9/08711* (2013.01); *G03G 9/08724* (2013.01); *G03G 9/08728* (2013.01); *G03G 9/08797* (2013.01)

(58) Field of Classification Search
CPC ..... G03G 9/08755; G03G 9/08711; G03G 9/08724; G03G 9/08797
USPC ..... 430/109.4, 109.3
See application file for complete search history.

(56) References Cited

U.S. PATENT DOCUMENTS

2011/0020741 A1 1/2011 Mizumori et al.

FOREIGN PATENT DOCUMENTS

| | | |
|---|---|---|
| JP | 2007-193069 | 8/2007 |
| JP | 2009-052005 | 3/2009 |
| JP | 2012-150467 | 8/2012 |
| JP | 2016-090750 | 5/2016 |
| JP | 2017-003985 | 1/2017 |
| JP | 2018-156074 | 10/2018 |
| WO | 2009/119055 | 10/2009 |

OTHER PUBLICATIONS

International Search Report dated Nov. 20, 2018 in International (PCT) Application No. PCT/JP2018/033420.

*Primary Examiner* — Mark A Chapman
(74) *Attorney, Agent, or Firm* — Wenderoth, Lind & Ponack, L.L.P.

(57) ABSTRACT

The present invention relates to a toner binder containing: a polyester resin (A); and a vinyl resin (B), wherein the polyester resin (A) is a resin obtained by crosslinking a polyester (A1) by one or more carbon-carbon bonds, the vinyl resin (B) is a polymer containing a monomer (a) as an essential constituent monomer, the monomer (a) is a C21-C40 (meth)acrylate having an acyclic hydrocarbon group, and the weight proportion of the monomer (a) in monomers constituting the vinyl resin (B) is 15 to 99% by weight based on the weight of the vinyl resin (B).

9 Claims, No Drawings

TONER BINDER AND TONER

TECHNICAL FIELD

The present invention relates to toner binders and toners.

BACKGROUND ART

Recent advancement in electrophotographic systems has brought a rapid increase in the demand for electrophotographic devices such as copy machines and laser printers and has also created the need for higher performance of these devices.

According to conventionally known methods and devices for full color electrophotographic images, an image is obtained by forming a latent image based on color image information on a latent image carrier such as an electrophotographic photoreceptor; developing a toner image using color toners corresponding to the colors of the latent image; and transferring the toner image to a transfer material. This image formation process is performed repeatedly. Then, the toner image on the transfer material is thermally fixed to produce a multicolor image.

For these processes to run smoothly, it is firstly required that the toner maintains a stable electrostatic charge level, and it is secondly required that the toner has good fixability to paper. In addition, the devices include heating elements in their fixing sections, and these heating elements raise the temperature in the devices. Thus, it is also required that the toner does not undergo blocking in the devices.

Further, there is a demand for further miniaturization, higher operation speed, and better image quality performance of electrophotographic devices, as well as for reduction in energy consumption in a fixing step. Thus, there is a strong demand for improving low-temperature fixability of the toner in order to save energy.

In addition, recently used transfer materials include various types of paper including recycled paper with a rough surface and coated paper with a smooth surface. In order to handle surface properties of these transfer materials, fixing devices with a large nip width, such as soft rollers and belt rollers, are preferably used. However, a larger nip width results in an increased contact area between the toner and fixing rollers. This causes so-called "high-temperature offset phenomenon" in which the fused toner is attached to the fixing rollers. Thus, offset resistance is a prerequisite.

In addition to the above, much higher gloss is required for multicolor images (full color images) than black-and-white images (monochrome images) due to processes such as reproduction of images such as photos. It is necessary to ensure that the resultant multicolor images have a smooth toner layer.

Thus, in forming a toner image, a toner is required to exert low-temperature fixability and offset resistance. Also, a formed toner image is required to exhibit high gloss. In addition, the demand is increasing for a highly glossy toner image that can be obtained in a wider working range.

Toner binders have a great influence on the toner properties mentioned above. While known resins for toner binders include polystyrene resin, styrene-acrylic resin, polyester resin, epoxy resin, polyurethane resin, and polyamide resin, polyester resin has recently attracted particular attention because the balance between storage stability and fixability can be easily achieved with the polyester resin.

To expand the fixation temperature range, Patent Literature 1 suggests a toner containing a polyester resin that contains an unsaturated carboxylic acid as a constituent.

This toner can prevent the high-temperature offset phenomenon to some extent, but has an insufficient lower limit fixation temperature. The demand for higher operation speed and lower energy consumption thus has not been fully met.

Meanwhile, Patent Literature 2 suggests a toner containing a crystalline vinyl resin as a material for decreasing the low-temperature fixing temperature.

This toner improves the low-temperature fixability, but has insufficient high-temperature offset resistance.

As described above, conventional techniques have not been able to provide superior toner binders or toners which maintain low-temperature fixability and offset resistance while satisfying all of pulverizability, image strength, heat-resistant storage stability, gloss, and durability.

CITATION LIST

Patent Literature

Patent Literature 1: JP 2017-003985 A
Patent Literature 2: JP 2007-193069 A

SUMMARY OF INVENTION

Technical Problem

The present invention aims to provide a superior toner binder and a superior toner which maintain low-temperature fixability and offset resistance while satisfying all of pulverizability, image strength, heat-resistant storage stability, electrostatic charge stability, gloss, and durability.

Solution to Problem

As a result of extensive examinations to solve the problems, the present inventors arrived at the present invention.

The present invention provides a toner binder containing: a polyester resin (A); and a vinyl resin (B), wherein the polyester resin (A) is a resin obtained by crosslinking a polyester (A1) by one or more carbon-carbon bonds, the vinyl resin (B) is a polymer containing a monomer (a) as an essential constituent monomer, the monomer (a) is a C21-C40 (meth)acrylate having an acyclic hydrocarbon group, and the weight proportion of the monomer (a) in monomers constituting the vinyl resin (B) is 15 to 99% by weight based on the weight of the vinyl resin (B). The present invention also provides a toner containing the toner binder.

Advantageous Effects of Invention

The present invention can provide a toner binder and a toner which maintain low-temperature fixability and offset resistance while having excellent pulverizability, image strength, heat-resistant storage stability, electrostatic charge stability, gloss, and durability.

DESCRIPTION OF EMBODIMENTS

The toner binder of the present invention contains: a polyester resin (A); and a vinyl resin (B), wherein the polyester resin (A) is a resin obtained by crosslinking a polyester (A1) by one or more carbon-carbon bonds, the vinyl resin (B) is a polymer containing a monomer (a) as an essential constituent monomer, the monomer (a) is a C21-C40 (meth)acrylate having an acyclic hydrocarbon group, and the weight proportion of the monomer (a) in monomers constituting the vinyl resin (B) is 15 to 99% by weight based on the weight of the vinyl resin (B).

The toner binder of the present invention is described in detail below.

The toner binder of the present invention essentially contains a polyester resin (A) that is a resin obtainable by crosslinking a polyester (A1) by one or more carbon-carbon bonds.

The polyester resin (A) is a resin having a structure obtained by crosslinking a polyester (A1) by one or more carbon-carbon bonds. Crosslinking by one or more carbon-carbon bonds is formed by direct bonding between at least one carbon atom contained in a polyester (A1) molecule and another carbon atom contained in the same or different polyester (A1) molecule.

The polyester (A1) may be any polyester that can be crosslinked by one or more carbon-carbon bonds.

For easy formation of a crosslinking structure, the polyester (A1) is preferably a polyester (A11) having carbon-carbon double bonds.

Preferably, at least part of the crosslinks by carbon-carbon bonds in the polyester resin (A) is formed by bonding between a carbon atom of one carbon-carbon double bond in a polyester (A11) molecule and a carbon atom of another carbon-carbon double bond in a polyester (A11) molecule.

The one carbon-carbon double bond and the other carbon-carbon double bond may be present in the same polyester (A11) molecule or different polyester (A11) molecules.

Instead of reacting the carbon-carbon double bonds of the polyester (A11), the polyester resin (A) may be obtained by a crosslinking method involving abstracting hydrogen atoms bonded to carbon atoms in the polyester (A1) by a hydrogen abstraction reaction (also referred to as a hydrogen atom abstraction reaction) by heating, for example.

Examples of the crosslinking reaction to form one or more carbon-carbon bonds include a reaction in which unsaturated doubles bonds are introduced into the main chain or a side chain of a polyester resin, and reacted by a radical addition reaction, a cationic addition reaction, or an anionic addition reaction, thus forming intermolecular carbon-carbon bonds, and a reaction in which a hydrogen atom abstraction reaction is performed with a peroxide or the like to form intermolecular carbon-carbon bonds.

The polyester resin having a network formed by the crosslinking reaction is insoluble in tetrahydrofuran (THF). Thus, whether the polyester resin has a network formed by a crosslinking reaction can be determined by whether the polyester resin contains a component insoluble in THF (THF insoluble).

The polyester resin (A) used in the toner binder of the present invention is a resin obtained by crosslinking the polyester (A1) by a crosslinking reaction that forms one or more carbon-carbon bonds. Of crosslinking reactions, a preferred crosslinking reaction that forms one or more carbon-carbon bonds is, in view of pulverizability and low-temperature fixability, a reaction in which the polyester (A11) having carbon-carbon double bonds is reacted by a radical addition reaction, a cationic addition reaction, or an anionic addition reaction to form intermolecular carbon-carbon bonds.

As long as the polyester resin (A) contains a crosslink formed by a carbon-carbon bond, the polyester resin (A) may also contain a crosslink formed by an ester bond or a crosslink formed by a polyaddition reaction.

The polyester resin (A) may include one polyester resin or may be a mixture of two or more polyester resins.

In the toner binder of the present invention, the polyester (A11) having carbon-carbon double bonds is preferably a polyester resin that contains an unsaturated carboxylic acid component (y) and/or an unsaturated alcohol component (z) and is obtained by polycondensation of a constituent that essentially includes the unsaturated carboxylic acid component (y) or the unsaturated alcohol component (z).

The polyester (A11) having carbon-carbon double bonds may contain a saturated alcohol component (x) or a saturated carboxylic acid component (w) as a constituent in addition to the essential component.

The polyester (A11) may be obtained by polycondensation using one of these components or two or more of these components in combination.

Herein, the bonds in an aromatic ring and a heterocycle are not taken into consideration in determining whether a compound is the unsaturated carboxylic acid component (y) or the saturated carboxylic acid component (w).

Similarly, the bonds in an aromatic ring and a heterocycle are not taken into consideration in determining whether a compound is an unsaturated alcohol component (z) or a saturated alcohol component (x).

Examples of the unsaturated alcohol component (z) include unsaturated monools (z1) and unsaturated diols (z2).

These may be used alone or in combination of two or more thereof.

Examples of the unsaturated monool (z1) include C2-C30 unsaturated monools. Preferred examples thereof include 2-propen-1-ol, palmitoleyl alcohol, elaidyl alcohol, oleyl alcohol, erucyl alcohol, and 2-hydroxyethyl methacrylate.

Examples of the unsaturated diol (z2) include C2-C30 unsaturated diols. Preferred examples thereof include ricinoleyl alcohol.

Examples of the saturated alcohol component (x) include saturated monools (x1), saturated diols (x2), and tri- or higher hydric saturated polyols (x3).

These may be used alone or in combination of two or more thereof.

Examples of the saturated monool (x1) include C1-C30 linear or branched alkyl alcohols (e.g., methanol, ethanol, isopropanol, 1-decanol, dodecyl alcohol, myristyl alcohol, cetyl alcohol, stearyl alcohol, arachidyl alcohol, behenyl alcohol, and lignoceryl alcohol).

In view of image strength and heat-resistant storage stability, preferred among these saturated monools are C8-C24 linear or branched alkyl alcohols. More preferred are C8-C24 linear alkyl alcohols. Still more preferred are dodecyl alcohol, stearyl alcohol, arachidyl alcohol, behenyl alcohol, and lignoceryl alcohol.

Examples of the saturated diol (x2) include: C2-C36 alkylene glycols (e.g., ethylene glycol, 1,2-propylene glycol, 1,3-propylene glycol, 1,4-butanediol, neopentyl glycol, 3-methyl-1,5-pentanediol, 1,6-hexanediol, 1,7-heptanediol, 1,8-octanediol, 1,9-nonanediol, 1,10-decanediol, 1,11-undecanediol, and 1,12-dodecanediol) (x21); C4-C36 alkylene ether glycols (e.g., diethylene glycol, triethylene glycol, dipropylene glycol, polyethylene glycol, polypropylene glycol, and polytetramethylene ether glycol) (x22); C6-C36 alicyclic diols (e.g., 1,4-cyclohexane dimethanol and hydrogenated bisphenol A) (x23); (poly)alkylene oxide adducts (preferably with an average number of moles added of 1 to 30) of the alicyclic diols (x24); aromatic diols (x25) such as monocyclic dihydric phenol (e.g., hydroquinone) and bisphenols; and alkylene oxide adducts (preferably with an average number of moles added of 2 to 30) of the aromatic diols (x26).

Preferred among these saturated diols (x2) are C2-C36 alkylene glycols (x21) and alkylene oxide adducts of the aromatic diols (x26) in view of low-temperature fixability and heat-resistant storage stability. More preferred are alkylene oxide adducts of bisphenols. The alkylene oxides preferably have a C2-C4 alkylene group. Preferred alkylene oxides include ethylene oxide, 1,2- or 1,3-propylene oxide, 1,2-, 2,3-, 1,3- or iso-butylene oxide, and tetrahydrofuran.

Alkylene oxide adducts of bisphenols are obtained by adding alkylene oxides (hereinafter the "alkylene oxide" may be abbreviated as "AO") to bisphenols. Examples of the bisphenols include one represented by formula (1) below.

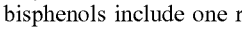

$$HO—Ar—P—Ar—OH \quad (1)$$

wherein P represents a C1-C3 alkylene group, $—SO_2—$, —O—, —S—, or a direct bond; and Ar represents a phenylene group in which a hydrogen atom may be optionally replaced with a halogen atom or with a C1-C30 alkyl group.

Examples of the bisphenols include bisphenol A, bisphenol F, bisphenol B, bisphenol AD, bisphenol S, trichlorobisphenol A, tetrachlorobisphenol A, dibromobisphenol F, 2-methyl bisphenol A, 2,6-dimethyl bisphenol A, and 2,2'-diethyl bisphenol F. They may be used in combination of two or more thereof.

As the alkylene oxides to be added to such bisphenols, C2-C4 alkylene oxides are preferred, and examples thereof include ethylene oxide (hereinafter the "ethylene oxide" may be abbreviated as "EO"), propylene oxide (hereinafter the "propylene oxide" may be abbreviated as "PO"), 1,2-, 2,3-, 1,3- or iso-butylene oxide, tetrahydrofuran, and combinations of two or more thereof.

The AO adducts of bisphenols preferably contain EO and/or PO as the AO in view of heat-resistant storage stability and low-temperature fixability.

The average number of moles of the AO added is preferably 2 to 30, more preferably 2 to 10, still more preferably 2 to 5.

Preferred among the alkylene oxide adducts of bisphenols are EO adducts (preferably with an average number of moles added of 2 to 4, more preferably 2 to 3) and/or PO adducts (preferably with an average number of moles added of 2 to 4, more preferably 2 to 3) of bisphenol A, in view of fixability, pulverizability, and heat-resistant storage stability of the toner.

Examples of the tri- or higher hydric saturated polyol (x3) include: C3-C36 tri- or higher hydric aliphatic polyols (x31); saccharides and derivatives thereof (x32); AO adducts (preferably with an average number of moles added of 1 to 30) of aliphatic polyols (x33); AO adducts (preferably with an average number of moles added of 2 to 30) of trisphenols (e.g., trisphenol PA) (x34); and AO adducts (preferably with an average number of moles added of 2 to 30) of novolac resins (including phenol novolac and cresol novolac, preferably with a degree of polymerization of 3 to 60) (x35).

Examples of the C3-C36 tri- or higher hydric aliphatic polyol (x31) include alkane polyols and intramolecular or intermolecular dehydrated products thereof. Examples thereof include glycerol, trimethylolethane, trimethylolpropane, pentaerythritol, sorbitol, sorbitan, polyglycerol, and dipentaerythritol.

Examples of the saccharide and the derivative thereof (x32) include sucrose and methyl glucoside.

Preferred among the tri- or higher hydric saturated polyols (x3) are C3-C36 tri- or higher hydric aliphatic polyols (x31) and AO adducts (preferably with an average number of moles added of 2 to 30) of novolac resins (including phenol novolac and cresol novolac, preferably with an average degree of polymerization of 3 to 60) (x35), in view of the balance between low-temperature fixability and hot offset resistance.

Preferred among the saturated alcohol components (x) in view of the balance between low-temperature fixability, hot offset resistance, and heat-resistant storage stability are C2-C36 alkylene glycols (x21), AO adducts (preferably with an average number of moles added of 2 to 30) of bisphenols, C3-C36 tri- or higher hydric aliphatic polyols (x31), and AO adducts (preferably with an average number of moles added of 2 to 30) of novolac resins (including phenol novolac and cresol novolac, preferably with an average degree of polymerization of 3 to 60) (x35).

More preferred among the saturated alcohol components (x) in view of heat-resistant storage stability are C2-C10 alkylene glycols, AO adducts (preferably with an average number of moles added of 2 to 5) of bisphenols, C3-C36 tri- to octahydric aliphatic polyols, and AO adducts (preferably with an average number of moles added of 2 to 30) of novolac resins (including phenol novolac and cresol novolac, preferably with an average degree of polymerization of 3 to 60).

Still more preferred are C2-C6 alkylene glycols, AO adducts (preferably with an average number of moles added of 2 to 5) of bisphenol A, and C3-C36 trihydric aliphatic polyols. Particularly preferred are ethylene glycol, propylene glycol, AO adducts (preferably with an average number of moles added of 2 to 3) of bisphenol A, and trimethylolpropane.

Preferred among the saturated alcohol components (x) in view of electrostatic charge stability are AO adducts (preferably with an average number of moles added of 2 to 5) of bisphenols, tri- to octahydric aliphatic polyols, and AO adducts (preferably with an average number of moles added of 2 to 30) of novolac resins (including phenol novolac and cresol novolac, preferably with an average degree of polymerization of 3 to 60).

More preferred saturated alcohol components (x) are AO adducts (with an average number of moles added of 2 to 5) of bisphenol A. Still more preferred are AO adducts (with an average number of moles added of 2 to 3) of bisphenol A.

The saturated alcohol component (x) may be a combination of the saturated diol (x2) and the tri- or higher hydric saturated polyol (x3). When they are used in combination, the mole ratio ((x2)/(x3)) of the saturated diol (x2) to the tri or higher hydric saturated polyol (x3) is preferably 99/1 to 80/20, more preferably 98/2 to 90/10 in view of hot offset resistance.

Examples of the unsaturated carboxylic acid component (y) include an unsaturated monocarboxylic acid (y1), an unsaturated dicarboxylic acid (y2), an unsaturated polycarboxylic acid (y3), and anhydrides or lower alkyl esters of these acids.

These may be used alone or in combination of two or more thereof.

Examples of the unsaturated monocarboxylic acid (y1) include C2-C30 unsaturated monocarboxylic acids. Examples thereof include acrylic acid, methacrylic acid, propiolic acid, 2-butyne acid, crotonic acid, isocrotonic acid, 3-butenoic acid, angelic acid, tiglic acid, 4-pentenoic acid, 2-ethyl-2-butenoic acid, 10-undecenoic acid, 2,4-hexadienoic acid, myristoleic acid, palmitoleic acid, sapienic acid, oleic acid, elaidic acid, vaccenic acid, gadoleic acid, erucic acid, and nervonic acid.

Examples of the unsaturated dicarboxylic acid (y2) include C4-050 alkene dicarboxylic acids. Examples thereof include alkenyl succinic acids (e.g., dodecenyl succinic acid), maleic acid, fumaric acid, citraconic acid, mesaconic acid, itaconic acid, glutaconic acid.

Preferred among these unsaturated carboxylic acid components (y) are C2-C10 unsaturated monocarboxylic acids and C4-C18 alkene dicarboxylic acids in view of the balance between low-temperature fixability and hot offset resistance, and more preferred are acrylic acid, methacrylic acid, alkenyl succinic acids (e.g., dodecenyl succinic acid), maleic acid, and fumaric acid.

Still more preferred are acrylic acid, methacrylic acid, maleic acid, fumaric acid, and combinations thereof.

Anhydrides or lower alkyl esters of these acids are also preferred.

Examples of the saturated carboxylic acid component (w) include aromatic carboxylic acids and aliphatic carboxylic acids. The saturated carboxylic acid components (w) may be used alone or in combination of two or more thereof.

Examples of the aromatic carboxylic acid include C7-C37 aromatic monocarboxylic acids (e.g., benzoic acid, toluic acid, 4-ethylbenzoic acid, and 4-propylbenzoic acid), C8-C36 aromatic dicarboxylic acids (e.g., phthalic acid, isophthalic acid, terephthalic acid, and naphthalene dicarboxylic acid), and C9-C20 tri- or higher valent aromatic polycarboxylic acids (e.g., trimellitic acid and pyromellitic acid).

Examples of the aliphatic carboxylic acid include C2-C50 aliphatic monocarboxylic acids (e.g., acetic acid, propionic acid, butyric acid, valeric acid, caproic acid, enanthic acid, caplyric acid, pelargonic acid, capric acid, lauric acid, myristic acid, palmitic acid, margaric acid, stearic acid, and behenic acid), C2-C50 aliphatic dicarboxylic acids (e.g., oxalic acid, malonic acid, succinic acid, adipic acid, lepargylic acid, and sebacic acid), and C6-C36 aliphatic tricarboxylic acids (e.g., hexanetricarboxylic acid).

The saturated carboxylic acid component (w) may be an anhydride or lower alkyl (C1-C4) ester (e.g., methyl ester, ethyl ester, or isopropyl ester) of any of the carboxylic acids, or such an anhydride or lower alkyl ester may be used in combination with any of the carboxylic acids.

Preferred among these saturated carboxylic acid components (w) are C7-C37 aromatic monocarboxylic acids, C2-C50 aliphatic dicarboxylic acids, C8-C20 aromatic dicarboxylic acids, and C9-C20 aromatic polycarboxylic acids in view of the balance between low-temperature fixability, hot offset resistance, and heat-resistant storage stability.

More preferred in view of heat-resistant storage stability and electrostatic charge stability are benzoic acid, adipic acid, alkyl succinic acid, terephthalic acid, isophthalic acid, trimellitic acid, pyromellitic acid, and combinations thereof. Still more preferred are adipic acid, terephthalic acid, trimellitic acid, and combinations thereof. Examples of the saturated carboxylic acid components (w) may also include anhydrides or lower alkyl esters of these acids.

The polyester (A11) in the toner binder of the present invention may be produced by any method. Preferably, as described above, the polyester (A11) is produced by polycondensation of a constituent including one or more unsaturated carboxylic acid components (y) and/or one or more unsaturated alcohol components (z).

In the toner binder of the present invention, the polyester (A11) having carbon-carbon double bonds is not limited, but is preferably a non-linear polyester in view of improving elasticity at high temperature. The non-linear polyester (A11) improves the heat-resistant storage stability and hot offset resistance. The non-linear polyester may be obtained by, for example, the combined use of the saturated diol (x2) and the tri- or higher hydric saturated polyol (x3) at the above ratio as the saturated alcohol components (x).

In the toner binder of the present invention, the polyester (A1), including the polyester (A11), can be produced in the same manner as common polyester production methods.

For example, the polyester can be produced by a reaction of constituent(s) under an inert gas (e.g., nitrogen gas) atmosphere, preferably at a reaction temperature of 150° C. to 280° C., more preferably 160° C. to 250° C., still more preferably 170° C. to 235° C. In order to ensure completion of the polycondensation reaction, the reaction time is preferably 30 minutes or more, more preferably 2 to 40 hours.

At this time, an esterification catalyst may be used, if necessary.

Examples of the esterification catalyst include: tin-containing catalysts (e.g., dibutyl tin oxide); antimony trioxide; titanium-containing catalysts such as titanium alkoxide, potassium oxalate titanate, titanium terephthalate, titanium terephthalate alkoxide, catalysts described in JP 2006-243715 A (e.g., titanium diisopropoxybis(triethanolaminate), titanium dihydroxy bis(triethanolaminate), titanium monohydroxy tris(triethanolaminate), titanylbis(triethanolaminate), and intramolecular polycondensation products thereof), and catalysts described in JP 2007-11307 A (e.g., titanium tributoxy terephthalate, titanium triisopropoxy terephthalate, and titanium diisopropoxy diterephthalate); zirconium-containing catalysts (e.g., zirconium acetate); and zinc acetate. Preferred among these are titanium-containing catalysts. It is also effective to reduce pressure in order to increase the rate of reaction in the last stage of the reaction.

In addition, a stabilizer may be added in order to stabilize the polyester polymerization. Examples of the stabilizer include hydroquinone, methyl hydroquinone, and hindered phenolic compounds.

For the polyester (A1) used in the reaction, the feed ratio of the total of the saturated alcohol components (x) and the unsaturated alcohol components (z) to the total of the unsaturated carboxylic acid components (y) and the saturated carboxylic acid components (w) is preferably 2/1 to 1/2, more preferably 1.5/1 to 1/1.3, still more preferably 1.4/1 to 1/1.2, as an equivalent ratio ((OH)/(COOH)) of hydroxyl groups to carboxyl groups. When the polyester (A1) is the polyester (A11), one or both of the unsaturated carboxylic acid component (y) and the unsaturated alcohol component (z) may be contained.

In the toner binder of the present invention, the polyester (A1) preferably has a glass transition temperature ($Tg_{A1}$) of −35° C. to 45° C.

A $Tg_{A1}$ of 45° C. or lower results in good low-temperature fixability. A $Tg_{A1}$ of −35° C. or higher results in good heat-resistant storage stability. The glass transition temperature ($Tg_{A}1$) of the polyester (A1) is more preferably −30° C. to 42° C., still more preferably −25° C. to 40° C., particularly preferably −20° C. to 37° C.

The glass transition temperature (Tg) can be measured by the method (DSC method) prescribed in ASTM D3418-82 using, for example, DSC Q20 available from TA Instruments.

In the toner binder of the present invention, the peak top molecular weight Mp of the polyester (A1) determined by gel permeation chromatography (GPC) is preferably 2,000 to 30,000, more preferably 3,000 to 20,000, still more preferably 4,000 to 12,000.

When the peak top molecular weight Mp of the polyester (A1) is 2,000 to 30,000, suitable gloss, low-temperature fixability, and hot offset resistance are obtained.

Now, a calculation method of the peak top molecular weight Mp is described.

First, a calibration curve is produced by gel permeation chromatography (GPC) using standard polystyrene samples.

Next, the samples are separated by GPC, and the count of separated samples in each retention time is measured.

Then, a molecular weight distribution chart is produced from logarithmic values of the calibration curve and the counts. A peak maximum value in the molecular weight distribution chart is the peak top molecular weight Mp.

When there are multiple peaks in the molecular weight distribution chart, the maximum value among these peaks is the peak top molecular weight Mp. Conditions for GPC measurement are as follows.

In the toner binder of the present invention, the peak top molecular weight Mp, the number average molecular weight (hereinafter may be abbreviated as "Mn"), and the weight average molecular weight (hereinafter may be abbreviated as "Mw") of resins such as polyester can be measured by GPC under the following conditions.

Device (an example): HLC-8120 available from Tosoh Corporation

Column (an example): TSK GEL GMH6, two columns (available from Tosoh Corporation)

Measurement temperature: 40° C.

Sample solution: 0.25% by weight solution in THF

Amount of solution to be injected: 100 μL

Detection device: refractive index detector

Reference material: standard polystyrene available from Tosoh Corporation (TSK standard polystyrene), 12 samples (molecular weight: 500, 1,050, 2,800, 5,970, 9,100, 18,100, 37,900, 96,400, 190,000, 355,000, 1,090,000, and 2,890,000)

For measurement of the molecular weight, each sample is dissolved in THF to a concentration of 0.25% by weight, and insolubles are filtered out by a glass filter to obtain a sample solution.

A preferred method for producing the polyester resin (A) is as follows.

First, at least one of the unsaturated carboxylic acid component (y) or the unsaturated alcohol component (z) and optionally the saturated carboxylic acid component (w) and/or the saturated alcohol component (x) as constituents are subjected to a condensation reaction, whereby a polyester (A11) having carbon-carbon double bonds in the molecule is obtained. Next, the polyester (A11) is allowed to react with a radical reaction initiator (c). Using the radicals generated from the radical reaction initiator (c), carbon-carbon double bonds derived from the unsaturated carboxylic acid component (y) and/or the unsaturated alcohol component (z) in the polyester (A11) are bonded to each other by a crosslinking reaction. Thus, the polyester resin (A) can be produced. This method is preferable in that the crosslinking reaction proceeds uniformly in a shorter time.

The radical reaction initiator (c) to be used for the crosslinking reaction of the polyester (A11) is not particularly limited. For example, an inorganic peroxide (c1), an organic peroxide (c2), or an azo compound (c3) may be used. Two or more of these radical reaction initiators may be used in combination.

Any inorganic peroxide (c1) may be used. Examples thereof include hydrogen peroxide, ammonium persulphate, potassium persulfate, and sodium persulfate.

Non-limiting examples of the organic peroxide (c2) include benzoyl peroxide, di-t-butyl peroxide, t-butyl cumyl peroxide, dicumyl peroxide, α,α-bis(t-butylperoxy) diisopropylbenzene, 2,5-dimethyl-2,5-bis(t-butylperoxy) hexane, di-t-hexyl peroxide, 2,5-dimethyl-2,5-di-t-butylperoxyhexine-3, acetyl peroxide, isobutyryl peroxide, octanoyl peroxide, decanoyl peroxide, lauroyl peroxide, 3,3,5-trimethylhexanoyl peroxide, m-tolyl peroxide, t-butyl peroxyisobutyrate, t-butyl peroxyneodecanoate, cumyl peroxyneodecanoate, t-butylperoxy-2-ethyl hexanoate, t-butylperoxy-3,5,5-trimethyl hexanoate, t-butyl peroxylaurate, t-butyl peroxybenzoate, t-butylperoxy isopropyl monocarbonate, and t-butyl peroxyacetate.

Non-limiting examples of the azo compound or diazo compound (c3) include 2,2'-azobis-(2,4-dimethyl valeronitrile), 2,2'-azobis isobutyronitrile, 1,1'-azobis (cyclohexane-1-carbonitrile), 2,2'-azobis-4-methoxy-2,4-dimethyl valeronitrile, and azobis isobutyronitrile.

Preferred among these are the organic peroxides (c2) because they have high initiator efficiency and do not produce toxic by-products such as cyanide.

Further, more preferred are reaction initiators having a high hydrogen abstraction ability because such reaction initiators efficiently promote a crosslinking reaction and can be used in smaller amounts. Still more preferred are radical reaction initiators having a high hydrogen abstraction ability such as benzoyl peroxide, di-t-butyl peroxide, t-butyl cumyl peroxide, dicumyl peroxide, α,α-bis(t-butylperoxy)diisopropylbenzene, 2,5-dimethyl-2,5-bis(t-butylperoxy)hexane, and di-t-hexyl peroxide.

The amount of the radical reaction initiator (c) used is not particularly limited, but it is preferably 0.1 to 50 parts by weight based on the total weight of the unsaturated carboxylic acid components (y) and the unsaturated alcohol components (z) used in the polymerization for producing the polyester (A11).

The radical reaction initiator in an amount of 0.1 parts by weight or more tends to facilitate the crosslinking reaction. The radical reaction initiator in an amount of 50 parts by weight or less tends to result in reduced odor. The amount is more preferably 30 parts by weight or less, still more preferably 20 parts by weight or less, particularly preferably 10 parts by weight or less.

It is preferred to use the radical reaction initiator (c) listed above in the amount described above to produce the polyester resin (A) by radical polymerization because the crosslinking reaction of carbon-carbon double bonds of the polyester (A11) proceeds suitably, thus improving hot offset resistance and heat-resistant storage stability of the toner, and image strength.

The carbon-carbon double bond content of the polyester (A11) is not particularly limited, but it is preferably 0.02 to 2.00 mmol/g based on the weight of the polyester (A11). The carbon-carbon double bond content is more preferably 0.06 to 1.9 mmol/g, still more preferably 0.10 to 1.5 mmol/g, particularly preferably 0.15 to 1.0 mmol/g based on the weight of the polyester (A11).

When the carbon-carbon double bond content is 0.02 to 2.0 mmol/g based on the weight of the polyester (A11), the crosslinking reaction proceeds suitably, thus improving hot offset resistance of the toner.

In the toner binder of the present invention, the carbon-carbon double bond content of the polyester (A11) is the number of millimoles of carbon-carbon double bonds contained in 1 g in total of the raw materials (e.g., alcohol components and carboxylic acid components) of the polyester (A11).

For example, when the raw materials of the polyester resin are fumaric acid (0.1 g) and a bisphenol A-PO (2 mol) adduct (0.9 g), 0.1 g of fumaric acid, which has one carbon-carbon double bond and a molecular weight of 116, is present in 1 g in total of the raw materials. Thus, the carbon-carbon double bond content is 0.1/116×1000=0.86 mmol/g.

For example, when the raw materials of the polyester resin are fumaric acid (0.3 g) and a bisphenol A-PO (2 mol) adduct (0.7 g), 0.3 g of fumaric acid, which has one carbon-carbon double bond and a molecular weight of 116, is present in 1 g in total of the raw materials. Thus, the carbon-carbon double bond content is 0.3/116×1000=2.59 mmol/g.

The polyester (A1) preferably has an acid value of 0.1 to 30 mg KOH/g, more preferably 0.1 to 25 mg KOH/g, still more preferably 0.1 to 10 mg KOH/g, particularly preferably 1 to 10 mg KOH/g in view of electrostatic charge stability and heat-resistant storage stability. When the acid value is 0.1 mg KOH/g or higher, good electrostatic charge stability can be obtained. When the acid value is 30 mg KOH/g or lower, good heat-resistant storage stability can be obtained.

The acid value of the polyester (A1) can be measured by a method prescribed in JIS K0070 (1992)

The toner binder of the present invention essentially contains a vinyl resin (B).

The vinyl resin (B) is a polymer containing a monomer (a) as an essential constituent monomer. The weight proportion of the monomer (a) in monomers constituting the vinyl resin (B) is 15 to 99% by weight based on the weight of the vinyl resin (B).

The monomer (a) is a C21-C40 (meth)acrylate having an acyclic hydrocarbon group. The monomer (a) having a carbon number of less than 21 deteriorates the heat-resistant storage stability. The monomer (a) having a carbon number of more than 40 deteriorates the low-temperature fixability.

Examples of the monomer (a) include (meth)acrylates having a linear alkyl group (C18-C36) (e.g., octadecyl (meth)acrylate, nonadecyl (meth)acrylate, eicosyl (meth) acrylate, heneicosanyl (meth)acrylate, behenyl (meth)acrylate, lignoceryl (meth)acrylate, ceryl (meth)acrylate, montanyl (meth)acrylate, triaconta (meth)acrylate, and dotriaconta (meth)acrylate) and (meth)acrylates having a branched alkyl group (C18-C36) (e.g., 2-decyltetradecyl (meth)acrylate).

Preferred among them are (meth) acrylates having a linear alkyl group (C18-C36) in view of the balance between the heat-resistant storage stability, low-temperature fixability, hot offset resistance, pulverizability, and image strength of the toner. More preferred are (meth)acrylates having a linear alkyl group (C18-C30). Still more preferred are octadecyl (meth)acrylate, eicosyl (meth)acrylate, behenyl (meth)acrylate, lignoceryl (meth)acrylate, ceryl (meth)acrylate, and triaconta (meth)acrylate. Particularly preferred are octadecyl acrylate, eicosyl acrylate, behenyl acrylate, and lignoceryl acrylate.

The monomers (a) may be used alone or in combination of two or more thereof.

The vinyl resin (B) may contain a monomer (b) having a vinyl group and having a carbon number of 6 or less as a constituent monomer other than the monomer (a) in view of hot offset resistance, heat-resistant storage stability, pulverizability, and electrostatic charge stability of the toner.

Examples of the monomer (b) include (meth)acrylic monomers having a carbon number of 6 or less (e.g., (meth)acrylic acid, methyl (meth)acrylate, ethyl (meth)acrylate, 2-hydroxypropyl acrylate, 2-hydroxyethyl (meth)acrylate, and ethyl-2-(hydroxymethyl) acrylate), vinyl ester monomers having a carbon number of 6 or less (e.g., vinyl acetate, vinyl propionate, and isopropenyl acetate), aliphatic hydrocarbon vinyl monomers having a carbon number of 6 or less (e.g., ethylene, propylene, butene, butadiene, isoprene, and 1,5-hexadiene), and monomers having a nitrile group and having a carbon number of 6 or less (e.g., (meth)acrylonitrile).

Preferred among them are (meth)acrylic acid, methyl (meth)acrylate, 2-hydroxyethyl (meth)acrylate, vinyl acetate, and (meth)acrylonitrile.

The monomers (b) may be used alone or in combination of two or more thereof.

The vinyl resin (B) may contain a monomer (d) as a constituent monomer other than the monomer (a) and monomer (b) in view of heat-resistant storage stability and hot offset resistance. Preferred monomers (d) include a styrene monomer (d1), a (meth)acrylic monomer (d2) having a carbon number of more than 6 excluding the monomers (a), a vinyl ester monomer (d3) having a carbon number of more than 6, and a monomer (d4) having at least one functional group selected from the group consisting of a nitrile group, a urethane group, a urea group, an amide group, an imide group, an allophanate group, and a biuret group and an ethylenically unsaturated bond and having a carbon number of more than 6. The monomers (d) may be used alone or in combination of two or more thereof.

Examples of the styrene monomer (d1) include styrene and alkyl styrenes having a C1-C3 alkyl group (e.g., α-methylstyrene and p-methylstyrene).

Preferred among them is styrene.

Examples of the (meth) acrylic monomer (d2) include alkyl (meth)acrylates having a C4-C17 alkyl group (e.g., butyl (meth)acrylate, 2-ethylhexyl (meth)acrylate, and lauryl (meth)acrylate), hydroxyalkyl (meth)acrylates having a C4-C17 alkyl group, aminoalkyl group-containing (meth) acrylates having a C4-C17 alkyl group (e.g., dimethylaminoethyl (meth)acrylate and diethylaminoethyl (meth)acrylate), and esters of C8-C20 unsaturated carboxylic acids and polyols (e.g., ethylene glycol di(meth)acrylate, propylene glycol di(meth)acrylate, neopentyl glycol di(meth)acrylate, trimethylolpropane tri(meth)acrylate, 1,6-hexanediol diacrylate, and polyethylene glycol di(meth)acrylate).

Preferred among them are butyl (meth)acrylate, 2-ethylhexyl (meth)acrylate, dimethylaminoethyl (meth)acrylate, and mixtures of two or more thereof.

Examples of the vinyl ester monomer (d3) include C7-C15 aliphatic vinyl esters and C9-C15 aromatic vinyl esters (e.g., methyl-4-vinylbenzoate).

Examples of the monomer (d4) having at least one functional group selected from the group consisting of a nitrile group, a urethane group, a urea group, an amide group, an imide group, an allophanate group, and a biuret group and an ethylenically unsaturated bond and having a carbon number of more than 6 include a monomer (d41) having a urethane group, a monomer (d42) having a urea group, a monomer (d43) having an amide group, a monomer (d44) having an imide group, a monomer (d45) having an allophanate group, and a monomer (d46) having a biuret group.

Examples of the monomer (d41) having a urethane group include monomers obtained by reacting a C2-C22 alcohol having an ethylenically unsaturated bond (e.g., 2-hydroxyethyl methacrylate or vinyl alcohol) and a C1-C30 isocyanate by a known method and monomers obtained by reacting a C1-C26 alcohol and a C1-C30 isocyanate having an ethylenically unsaturated bond by a known method.

Examples of the C1-C30 isocyanate include monoisocyanate compounds (e.g., benzene sulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethylphenyl isocyanate, 3,5-dimethylphenyl isocyanate, and 2,6-dipropylphenylisocyanate), aliphatic diisocyanate compounds (e.g., trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate, and 2,4,4-trimethylhexamethylene diisocyanate), alicyclic diisocyanate compounds (e.g., 1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate, and hydrogenated tetramethylxylylene diisocyanate), and aromatic diisocyanate compounds (e.g., phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenyl ether diisocyanate, 4,4'-diphenyl diisocyanate, 1,5-naphthalene diisocyanate, and xylylene diisocyanate).

Examples of the C1-C26 alcohol include methanol, ethanol, propanol, isopropyl alcohol, butanol, t-butyl alcohol, pentanol, heptanol, octanol, 2-ethylhexanol, nonanol, decanol, undecyl alcohol, lauryl alcohol, dodecyl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol, and erucyl alcohol.

Examples of the C1-C30 isocyanate having an ethylenically unsaturated bond include 2-isocyanatoethyl (meth) acrylate, 2-[0-(1'-methylpropylideneamino)carboxyamino] ethyl (meth)acrylate, 2-[(3,5-dimethylpyrazolyl) carbonylamino]ethyl (meth)acrylate, and 1,1-(bis(meth) acryloyloxymethyl)ethyl isocyanate.

Examples of the monomer (d42) having a urea group include monomers obtained by reacting, by a known method, a C3-C22 amine (exemplary monovalent C3-C22 amines include primary amines such as normal butylamine, t-butylamine, propylamine, and isopropylamine, secondary amines such as diethylamine, dinormal propylamine, and dinormal butylamine, aniline, and cyclohexylamine) and a C1-C30 isocyanate having an ethylenically unsaturated bond.

Examples of the monomer (d43) having an amide group include monomers obtained by reacting, by a known method, a C1-C30 amine and a C3-C30 carboxylic acid having an ethylenically unsaturated bond (e.g., acrylic acid or methacrylic acid).

Examples of the monomer (d44) having an imide group include: monomers obtained by reacting, by a known method, ammonia and a C4-C10 carboxylic anhydride having an ethylenically unsaturated bond (e.g., maleic anhydride or acrylic anhydride), and monomers obtained by reacting, by a known method, a C1-C30 primary amine and a C4-C10 carboxylic anhydride having an ethylenically unsaturated bond.

Examples of the monomer (d45) having an allophanate group include monomers obtained by reacting, by a known method, the monomer (d41) having a urethane group and a C1-C30 isocyanate.

Examples of the monomer (d46) having a biuret group include monomers obtained by reacting, by a known method, the monomer (d42) having a urea group and a C1-C30 isocyanate.

The use of the monomer (d4) enables introduction into the vinyl resin (B) of at least one functional group selected from the group consisting of a urethane group, a urea group, an amide group, an imide group, an allophanate group, and biuret group.

Instead of the method using the monomers (d41) to (d46), the following method may be used to introduce at least one functional group selected from the group consisting of a urethane group, a urea group, an amide group, an imide group, an allophanate group, and a biuret group into the vinyl resin (B).

First, of the two compounds used for obtaining any of the monomers (d41) to (d46) (the compound having an ethylenically unsaturated bond and the other compound), the compound having an ethylenically unsaturated bond is reacted with the monomer (a). Next, the polymer of the compound having an ethylenically unsaturated bond and the monomer (a) is reacted with the other compound. By this procedure, "the polymer of the compound having an ethylenically unsaturated bond and the monomer (a)" is bonded to "the other compound" to give the vinyl resin (B) During this reaction, "the polymer of the compound having an ethylenically unsaturated bond and the monomer (a)" is bonded to "the other compound" via a urethane group, a urea group, an amide group, an imide group, an allophanate group, or a biuret group, thus introducing at least one functional group selected from the group consisting of a urethane group, a urea group, an amide group, an imide group, an allophanate group, and a biuret group into the vinyl resin (B).

Although this method does not use the monomer (d4) as a monomer to constitute the vinyl resin (B), it produces the same compound as the method that uses the monomer (d4). Thus, it may be expressed as a "method that uses the monomer (d4)" for convenience.

Preferred among the monomers (d4) are reaction products of 2-isocyanatoethyl (meth) acrylate and methanol and reaction products of 2-isocyanatoethyl (meth)acrylate and dinormalbutylamine.

Preferred among the monomers (d) are styrene, butyl (meth)acrylate, 2-ethylhexyl (meth)acrylate, reaction products of 2-isocyanatoethyl (meth) acrylate and methanol, and reaction products of 2-isocyanatoethyl (meth)acrylate and dinormalbutylamine in view of low-temperature fixability, heat-resistant storage stability, pulverizability, and price of raw materials. More preferred is styrene.

The vinyl resin (B) may contain other monomers as constituent monomers other than the monomer (a), monomer (b), and monomer (d). Examples of such other monomers include divinylbenzene and sodium alkylallylsulfosuccinate.

As mentioned above, the weight proportion of the monomer (a) in monomers constituting the vinyl resin (B) is 15 to 99% by weight based on the weight of the vinyl resin (B). When the proportion is less than 15% by weight, the low-temperature fixability is reduced. When the proportion is more than 99% by weight, the hot offset resistance is reduced.

In view of the balance between low-temperature fixability, hot offset resistance, and heat-resistant storage stability, the proportion is preferably 30 to 99% by weight, more preferably 50 to 98% by weight, still more preferably 55 to 97% by weight, particularly preferably 60 to 95% by weight.

The monomers constituting the vinyl resin (B) preferably further include the monomer (b), more preferably further include the monomer (d) in view of heat-resistant storage stability. Still more preferably, the total amount of the monomer (b) and the monomer (d) is 2 to 50% by weight based on the weight of the vinyl resin (B).

The vinyl resin (B) in the toner binder of the present invention preferably satisfies relation (2) below in view of heat-resistant storage stability and electrostatic charge stability.

$$1.1 \leq |SP(x)-SP(a)| \leq 8.0 \quad \text{Relation (2):}$$

In relation (2), SP(a) is the solubility parameter (hereinafter abbreviated as SP value) of a homopolymer of the monomer (a) and SP(x) is the SP value of a polymer of all the monomers other than the monomer (a).

The SP value $(cal/cm^3)^{0.5}$ in the toner binder of the present invention is the value at 25° C. calculated by the method disclosed in Robert F. Fedors et al., Polymer engineering and science, vol. 14, pp. 151-154.

In view of heat-resistant storage stability of the resulting toner, the vinyl resin (B) more preferably satisfies $1.5 \leq |SP(x)-SP(a)| \leq 6.0$.

In production of the toner binder of the present invention, the weight ratio ((A1)/(B)) of the polyester (A1) to the vinyl resin (B) is preferably 5/95 to 50/50, more preferably 7/93 to 45/60, still more preferably 12/88 to 38/62 in view of the balance between low-temperature fixability, hot offset resistance, and heat-resistant storage stability.

When the vinyl resin (B) contains THF insolubles, the amount of the THF insolubles is preferably 1.0% by weight or less, more preferably 0.1 to 1.0% by weight.

The vinyl resin (B) preferably contains no THF insolubles in view of low-temperature fixability.

The vinyl resin (B) preferably has an acid value of 40 or lower, more preferably 0 to 20, still more preferably 0 to 5 in view of heat-resistant storage stability and electrostatic charging properties.

The acid value of the vinyl resin (B) can be measured by a method prescribed in JIS K0070.

The Mn of the THF solubles of the vinyl resin (B) is preferably 1,000 to 300,000 in view of the balance between heat-resistant storage stability and low-temperature fixability of the toner.

The Mw of the THF solubles of the vinyl resin (B) is preferably 1,000 to 300,000 in view of the balance between hot offset resistance, heat-resistant storage stability, and low-temperature fixability of the toner.

The Mn and Mw of the vinyl resin (B) can be measured by the same method as for the polyester resin.

The vinyl resin (B) of the toner binder of the present invention can be produced by polymerizing a monomer composition containing the monomer (a) and optionally the monomer (b) and the monomer (d) by a known method (e.g., the method disclosed in JP H05-117330 A). For example, the vinyl resin (B) can be synthesized by a solution polymerization method in which the monomers are reacted in the presence of a radical reaction initiator (e.g., azobisisobutyronitrile) in a solvent (e.g., toluene).

The radical reaction initiator may be the radical reaction initiator (c) described above. Preferred radical reaction initiators (c) are the same as those described above.

The toner binder of the present invention may contain compounds used in the polymerization of the vinyl resin (B) and their residues within the range that does not impair the effects of the present invention.

The toner binder of the present invention is obtained by, for example, mixing the polyester resin (A) and the vinyl resin (B) by a method described later. The toner binder is preferably obtained by crosslinking carbon-carbon double bonds derived from the polyester (A11) having carbon-carbon double bonds in a mixture of the polyester (A11) having carbon-carbon double bonds and the vinyl resin (B). The crosslinking reaction of the polyester resin (A) in the method tends to proceed uniformly in a shorter time, and the toner binder obtained by this method is preferred in view of the balance between low-temperature fixability, hot offset resistance, and heat-resistant storage stability.

The toner binder of the present invention may contain resins other than the polyester resin (A) and the vinyl resin (B), as well as known additives (e.g., a release agent).

The toner binder of the present invention preferably has at least one endothermic peak top temperature (Tm) derived from the vinyl resin (B) within the range of 40° C. to 100° C. on a differential scanning calorimetry curve obtained by differential scanning calorimetry (also referred to as DSC analysis). The toner binder more preferably has at least one endothermic peak top temperature (Tm) within the range of 45° C. to 80° C. The toner binder having the peak top temperature (Tm) within the range has a good balance between low-temperature fixability, heat-resistant storage stability, and gloss. This is because the vinyl resin (B) rapidly melts at the endothermic peak top temperature (Tm) derived from the vinyl resin (B), thus reducing the viscosity of the toner binder, and also because the toner binder satisfies the storage stability required for the resulting toner.

The endothermic peak top temperature (Tm) derived from the vinyl resin (B) is determined with a differential scanning calorimeter. Specifically, the toner binder is held at 30° C. for 10 minutes, heated from 30° C. to 150° C. at 10° C./min by first heating, then held at 150° C. for 10 minutes, subsequently cooled to 0° C. at 10° C./min, then held at 0° C. for 10 minutes, and then heated from 0° C. to 150° C. at 10° C./min by second heating. The endothermic peak top temperature (Tm) is a temperature indicating the top of an endothermic peak derived from the vinyl resin (B) on a differential scanning calorimetry curve obtained in the second heating. When there are a plurality of peaks derived from the vinyl resin (B), the endothermic capacity is calculated from each endothermic peak. Tm is the peak top temperature of the endothermic peak that shows the largest endothermic capacity.

The endothermic peak top temperature (Tm) of the toner binder can be adjusted to the above preferable range by, for example, adjusting the carbon number of the monomer (a) of the vinyl resin (B), adjusting the weight ratio of the monomer (a) of the vinyl resin (B), or satisfying relation (2). Commonly, the endothermic peak top temperature (Tm) is increased by increasing the carbon number of the monomer (a), increasing the weight ratio of the monomer (a), or increasing the weight average molecular weight of the vinyl resin (B). When the amount of the vinyl resin (B) is small, increasing the difference in SP value between the polyester resin (A) and the vinyl resin (B) prevents a decrease in the endothermic peak top temperature (Tm).

The endothermic peak top temperature (Tm) is determined with a differential scanning calorimeter under the following conditions. The differential scanning calorimeter may be, for example, DSC Q20 available from TA Instruments.

<Analysis conditions>

10. (1) Holding at 30° C. for 10 minutes
(2) Heating to 150° C. at 10° C./min
(3) Holding at 150° C. for 10 minutes
(4) Cooling to 0° C. at 10° C./min
(5) Holding at 0° C. for 10 minutes
(6) Heating to 150° C. at 10° C./min
(7) Analyzing each endothermic peak on the differential scanning calorimetry curve obtained in (6).

The storage modulus G' of the toner binder of the present invention preferably satisfies relation (1) in view of offset resistance, low-temperature fixability, and image strength of the resulting toner.

$$1.2 \leq \ln(G'_{Tm-10})/\ln(G'_{Tm+30}) \leq 2.6 \quad \text{Relation (1):}$$

Values are calculated by rounding to the first decimal place.

The storage modulus G' more preferably satisfies relation (1-2): $1.3 \leq \ln(G'_{Tm-10})/\ln(G'_{Tm+30}) \leq 2.4$, more preferably relation (1-3): $1.4 \leq \ln(G'_{Tm-10})/\ln(G'_{Tm+30}) \leq 2.2$, particularly preferably relation (1-4): $1.4\ \ln(G'_{Tm-10})/\ln(G'_{Tm+30}) \leq 2.0$.

In relation (1) and relations (1-2) to (1-4), $G'_{Tm-10}$ is the storage modulus (Pa) of the toner binder at a toner binder temperature of (Tm−10)° C., and $G'_{Tm+30}$ is the storage modulus (Pa) of the toner binder at a toner binder temperature of (Tm+30°) C.

$\ln(G'_{Tm-10})/\ln(G'_{Tm+30})$ can be adjusted by adjusting the weight ratio of the polyester (A1) to the vinyl resin (B), the weight average molecular weight of the vinyl resin (B), and the type and amount of the monomer (a), monomer (b), or monomer (d) Specifically, for example, $\ln(G'_{Tm-10})/\ln(G'_{Tm+30})$ can be increased by decreasing the weight ratio of the polyester (A1), decreasing the weight average molecular weight of the vinyl resin (B), decreasing the polarity of the monomer (b) or the monomer (d), increasing the amount of the monomer (a) or the monomer (b), or decreasing the amount of the monomer (d).

The storage modulus G' of the toner binder of the present invention is measured with the following viscoelasticity measuring device under the following conditions.

Device: ARES-24A (available from Rheometric Scientific, Inc.)

Fixture: 25-mm parallel plate

Frequency: 1 Hz

Strain: 5%

Temperature increase rate: 5° C./min

The toner binder of the present invention preferably has at least one inflection point indicating the glass transition temperature ($Tg_T$) within the temperature range of −30° C. to 80° C. on a differential scanning calorimetry curve obtained by differential scanning calorimetry (DSC). The inflection point indicating the glass transition temperature ($Tg_T$) is more preferably within the temperature range of 35° C. to 65° C. When the inflection point indicating the glass transition temperature ($Tg_T$) is within the temperature range of −30° C. or higher, good heat-resistant storage stability can be obtained. When the inflection point indicating the glass transition temperature ($Tg_T$) is within the temperature range of 80° C. or lower, good fixability can be obtained.

The glass transition temperature ($Tg_T$) can be determined by the method (DSC method) prescribed in ASTM D3418-82. The glass transition temperature ($Tg_T$) can be measured with, for example, DSC Q20 available from TA Instruments.

<Analysis Conditions>

(1) Heating from 30° C. to 150° C. at 20° C./min (2) Holding at 150° C. for 10 minutes (3) Cooling to −35° C. at 20° C./min (5) Holding at −35° C. for 10 minutes (6) Heating to 150° C. at 20° C./min (7) Analyzing the differential scanning calorimetry curve obtained in (6).

The toner binder of the present invention may contain tetrahydrofuran (THF) insolubles in some cases.

The amount (% by weight) of the THF insolubles in the toner binder of the present invention is preferably 50% by weight or less, more preferably 30% by weight or less, still more preferably 15% by weight or less, particularly preferably 0.1 to 10% by weight, in view of the balance between gloss, hot offset resistance, and low-temperature fixability.

The amount (% by weight) of the THF insolubles in the toner binder of the present invention is determined by the following method.

THF (50 mL) is added to a sample (0.5 g), and the mixture is stirred and refluxed for three hours. After cooling, the insolubles are separated by filtration with a glass filter, and the resin remaining on the glass filter is dried at 80° C. under reduced pressure for three hours. The weight of the dried resin remaining on the glass filter is assumed to be the weight of the THF insolubles, and the weight of the THF insolubles is subtracted from the weight of the sample to determine the weight of the THF solubles. Then, the percentage by weight of the THF insolubles and the percentage by weight of THF solubles are calculated.

The Mn of THF solubles in the toner binder of the present invention is preferably 500 to 24,000, more preferably 700 to 17,000, still more preferably 900 to 12,000 in view of the balance between heat-resistant storage stability and low-temperature fixability of a toner.

The Mw of the THF solubles in the toner binder of the present invention is preferably 5,000 to 120,000, more preferably 7,000 to 100,000, still more preferably 9,000 to 90,000, particularly preferably 10,000 to 80,000 in view of the balance between hot offset resistance and low-temperature fixability of a toner.

The molecular weight distribution Mw/Mn of the THF solubles in the toner binder of the present invention is preferably 2 to 30, more preferably 2.5 to 28, still more preferably 3 to 26 in view of the balance between hot offset resistance, heat-resistant storage stability, and low-temperature fixability of a toner.

The toner binder of the present invention preferably has an organic solvent content of 50 to 2000 ppm based on the weight of the toner binder. The toner binder having an organic solvent content of 2000 ppm or less has good heat-resistant storage stability and less odor. The toner binder having an organic solvent content of 50 ppm or more has good hot offset resistance and gloss. The organic solvent content of the toner binder is more preferably 100 to 1500 ppm, still more preferably 150 to 1000 ppm, particularly preferably 200 to 500 ppm.

Even when the polyester (A1) is crosslinked using the radical reaction initiator (c), and the reaction produces decomposition products of the radical reaction initiator (c), adjusting the amount of the organic solvent, which is one of the decomposition products, to be in the above range allows the resulting toner to have less odor and excellent hot offset resistance, pulverizability, image strength, and fluidity.

For example, the organic solvent content can be controlled by the following (1) to (3) during production of the polyester resin (A), the vinyl resin (B), and the toner binder: (1) control of the amount of the organic solvent used, (2) control of the amount of the initiator used (control of the initiator decomposition products), and (3) control by desolvation of the organic solvent used in (1) and (2) and the initiator decomposition residue.

For (3), the desolvation of the organic solvent and the initiator decomposition residue may be performed by any method. For example, the toner binder may be pulverized, fed into a twin-screw extruder, and the pressure is reduced via the vent port while the pulverized toner binder is conveyed in the melted state. At this time, the organic solvent content of the toner binder can be controlled by adjusting the melting temperature, the screw rotation rate, and the degree of pressure reduction. The desolvation can also be performed by subjecting the toner binder to a pressure reduction at a given temperature. The pressure may be reduced while stirring using a stirrer. At this time, the organic solvent content of the toner binder can be controlled by adjusting the temperature, the degree of pressure reduction, the stirring rate, and the like. The temperature in the desolvation is preferably 20° C. to 200° C., more preferably 30° C. to 170° C., still more preferably 40° C. to 160° C. The pressure in the desolvation is preferably reduced to 0.01 to 100 kPa, more preferably to 0.1 to 95 kPa, still more preferably 1 to 90 kPa.

The raw materials may be reacted in a twin-screw extruder while at the same time the pressure is reduced via the vent port. When the raw materials are reacted in a reaction container, the desolvation may be performed by a pressure reduction after the reaction in the same container. At this time, the organic solvent content in the binder can be controlled by adjusting the same factors as above.

The organic solvent content in the toner binder can also be controlled by pulverizing the toner binder and placing the pulverized toner binder in a drier whose temperature and pressure (normal pressure or reduced pressure) are adjusted according to the type of the organic solvent to be removed.

Methods that allow quick desolvation are preferable, because such methods are less likely to cause transesterification of the polyester resin (A) and the vinyl resin (B), thus leading to good hot offset resistance and low-temperature fixability.

The organic solvent content (ppm) can be measured by, for example, gas chromatography or gas chromatography-mass spectrometry under the following conditions.

The organic solvent content of the toner binders according to the examples and comparative examples was measured under the following conditions.

[Gas Chromatography Conditions]
Gas chromatograph: Agilent 6890N
Mass spectrometer: Agilent 5973 inert
Column: ZB-WAX (liquid phase: (14%-cyanopropyl-phenyl)methylpolysiloxane) 0.25 mm×30m, df=1.0 μm
Column temperature: from 70° C. to 300° C. (10° C./min)
Injection temperature: 200° C.
Split ratio: 50:1
Injection volume: 1 μL
Helium flow rate: 1 mL/min
Detector: MSD The organic solvent contained in the toner binder is not limited. Examples thereof include ethanol, normal propyl alcohol, isopropyl alcohol, n-butanol, s-butanol, t-butanol, diacetone alcohol, 2-ethylhexanol, acetone, methyl ethyl ketone, methyl isobutyl ketone, methyl n-butyl ketone, acetonitrile, dimethylacetamide, dimethylformamide, N-methylpyrrolidone, ethylene glycol, diethyl ether, diisopropyl ether, tetrahydrofuran, 1,4-dioxane, 1,3-dioxane, 1,3-oxolane, methyl cellosolve, ethyl cellosolve, butyl cellosolve, ethyl carbitol, butyl carbitol, propylene glycol monopropyl ether, propylene glycol monobutyl ether, 1,2-dichloroethane, 1,2-dichloroethylene, 1,1,2,2-tetrachloroethane, trichloroethylene, tetrachloroethylene, hexane, pentane, benzene, heptane, toluene, xylene, cresol, chlorobenzene, styrene, isobutyl acetate, isopropyl acetate, isopentyl acetate, ethyl acetate, n-propyl acetate, n-butyl acetate, n-pentyl acetate, methyl acetate, cyclohexanol, cyclohexanone, methylcyclohexanol, methylcyclohexanone, dichloromethane, orthodichlorobenzene, dimethylsulfoxide, acetic anhydride, acetic acid, hexamethylphosphoric triamide, triethylamine, pyridine, acetophenone, t-hexyl alcohol, t-amyl alcohol, and t-butoxybenzene.

Preferred among the organic solvents are C2-C10 compounds in view of heat-resistant storage stability and odors. More preferred are C3-C8 compounds. Still more preferred are acetone, isopropyl alcohol, and t-butanol.

A method for producing the toner binder is described below.

The toner binder is not limited as long as it contains the polyester resin (A) and the vinyl resin (B). For example, when mixing the polyester resin (A), the vinyl resin (B), and additives, the mixing method may be a known method commonly used, such as powder mixing, melt mixing, or solvent mixing. The polyester resin (A), the vinyl resin (B), and optional additives may be mixed during toner production. Preferred among the methods is melt mixing, which enables uniform mixing and eliminates the need for desolvation.

Examples of mixing devices for powder mixing include a Henschel mixer, a Nauta mixer, and a Banbury mixer. A Henschel mixer is preferred.

Examples of mixing devices for melt mixing include batch mixing devices such as a reaction vessel, and continuous mixing devices. Continuous mixing devices are preferred in order to uniformly mix at an appropriate temperature in a short time. Examples of the continuous mixing devices include static mixers, extruders, continuous kneaders, and three-roll mills.

Solvent mixing may be performed by a method in which the polyester resin (A) and the vinyl resin (B) are dissolved and homogenized in solvent(s) (e.g., ethyl acetate, THF, or acetone), followed by desolvation and pulverization, a method in which the polyester resin (A) and the vinyl resin (B) are dissolved in solvent(s) (e.g., ethyl acetate, THF, or acetone) and dispersed in water, followed by granulation and desolvation, or a method in which the polyester (A11) is crosslinked while the polyester (A11) and the vinyl resin (B) are melt-mixed.

Preferred among them is a method in which the polyester (A11) is crosslinked while the polyester (A11) and the vinyl resin (B) are melt-mixed. Specifically, this melt mixing may be performed by a method in which a mixture of the polyester (A11) and the vinyl resin (B) is fed into a twin-screw extruder at a constant rate, and simultaneously the radical reaction initiator (c) is fed at a constant rate so as to cause a reaction while these components are kneaded and conveyed at a temperature of 100° C. to 200° C.

The polyester (A11) and the vinyl resin (B) as reaction raw materials to be fed into a twin-screw extruder may be fed in the form of resin reaction mixtures into the extruder directly without being cooled. Alternatively, the produced resins may be cooled and pulverized first, and then fed in the form of particles into the twin-screw extruder.

The method for melt mixing is not limited to any of these specific exemplary methods. Needless to say, melt mixing can be performed by an appropriate method such as one in which raw materials are fed into a reaction container, heated at a temperature high enough to melt the raw materials, and then mixed.

The toner of the present invention contains the toner binder of the present invention.

The toner of the present invention may contain, in addition to the toner binder of the present invention, one or more known additives selected from a colorant, a release agent, a charge control agent, a fluidizer, and the like as needed.

Any dyes and pigments used as coloring agents for toners may be used as the colorant. Examples thereof include carbon black, iron black, Sudan black SM, Fast Yellow G, Benzidine Yellow, Pigment Yellow, Indo Fast Orange, Irgazin Red, Paranitroaniline Red, Toluidine Red, Carmine FB, Pigment Orange R, Lake Red 2G, Rhodamine FB, Rhodamine B Lake, Methylviolet B Lake, Phthalocyanine Blue, Pigment Blue, Brilliant Green, Phthalocyanine Green, Oil Yellow GG, Kayaset YG, Orasol Brown B, and Oil Pink OP. These colorants may be used alone or in combination of two or more of them. If necessary, magnetic powder (powder of a ferromagnetic metal such as iron, cobalt, or nickel, or a compound such as magnetite, hematite, or ferrite) may be added to also serve as a colorant.

The amount of the colorant is preferably 1 to 40 parts by weight, more preferably 3 to 10 parts by weight, relative to 100 parts by weight of the toner binder of the present invention. The amount of magnetic powder, if used, is preferably 20 to 150 parts by weight, more preferably 40 to 120 parts by weight.

The release agent preferably has a flow softening point (T1/2) of 50° C. to 170° C. as measured with a flow tester. Examples thereof include low molecular weight polypropylene, low molecular weight polyethylene, low molecular weight polypropylene-polyethylene copolymers, aliphatic hydrocarbon waxes (e.g., polyolefin wax, microcrystalline wax, paraffin wax, and Fischer-Tropsch wax) and oxides thereof, carnauba wax, montan wax, Sasol wax, and deacidified waxes of these waxes, ester waxes (e.g., fatty acid ester waxes), fatty acid amides, fatty acids, higher alcohols, fatty acid metal salts, and mixtures thereof.

The flow softening point (T1/2) of the release agent was measured by the following method.

<Method for Measuring Flow Softening Point (T1/2)>

A descending type flow tester (e.g., CFT-500D available from Shimadzu Corporation) is used. A measurement sample (1 g) is extruded from a nozzle having a diameter of 1 mm and a length of 1 mm by application of a load of 1.96 MPa with a plunger, while the sample is heated at a temperature increase rate of 6° C./min. A graph of "plunger descending amount (flow value)" against "temperature" is thus plotted. The temperature corresponding to 1/2 of the maximum plunger descending amount (temperature at which half of the measurement sample has flowed out) on the graph is determined as the flow softening point (T1/2).

Examples of the polyolefin wax include (co)polymers of olefins (e.g., ethylene, propylene, 1-butene, isobutylene, 1-hexene, 1-dodecene, 1-octadecen, and mixtures thereof) (including those obtained by (co)polymerization and thermally degraded polyolefins), oxides of (co)polymers of olefins by oxygen and/or ozone, (co)polymers of olefins modified by maleic acid (e.g., products modified by maleic acid and its derivatives (e.g., maleic anhydride, monomethyl maleate, monobutyl maleate, and dimethyl maleate)), (co) polymers of olefins and an unsaturated carboxylic acid (e.g., (meth)acrylic acid, itaconic acid, or maleic anhydride) and/or an unsaturated carboxylic acid alkyl ester (e.g., a (meth) acrylic acid alkyl (C1-C18 alkyl) ester or a maleic acid alkyl (C1-C18 alkyl) ester), and Sasol Wax.

Examples of the higher alcohol include C30-C50 aliphatic alcohols such as triacontanol. Examples of the fatty acid include C30-C50 fatty acids, such as triacontanecarboxylic acid.

Examples of the charge control agent include nigrosine dyes, triphenylmethane dyes containing a tertiary amine as a side chain, quaternary ammonium salts, polyamine resins, imidazole derivatives, quaternary ammonium salt group-containing polymers, metal-containing azo dyes, copper phthalocyanine dyes, salicylic acid metal salts, boron complexes of benzilic acid, sulfonic acid group-containing polymers, fluorine-containing polymers, and halogen-substituted aromatic ring-containing polymers.

Examples of the fluidizer include colloidal silica, alumina powder, titanium oxide powder, and calcium carbonate powder.

The amount of the toner binder in the toner is preferably 30 to 97% by weight, more preferably 40 to 95% by weight, still more preferably 45 to 92% by weight based on the weight of the toner.

The amount of the colorant is preferably 0.05 to 60% by weight, more preferably 0.1 to 55% by weight, still more preferably 0.5 to 50% by weight based on the weight of the toner.

The amount of the release agent is preferably 0 to 30% by weight, more preferably 0.5 to 20% by weight, still more preferably 1 to 10% by weight based on the weight of the toner.

The amount of the charge control agent is preferably 0 to 20% by weight, more preferably 0.1 to 10% by weight, still more preferably 0.5 to 7.5% by weight based on the weight of the toner.

The amount of the fluidizer is preferably 0 to 10% by weight, more preferably 0 to 5% by weight, still more preferably 0.1 to 4% by weight based on the weight of the toner.

The total amount of the additives is preferably 3 to 70% by weight, more preferably 4 to 58% by weight, still more preferably 5 to 50% by weight based on the weight of the toner.

The toner having the above composition easily achieves good hot offset resistance, image strength, heat-resistant storage stability, fluidity, electrostatic charge stability, bending resistance, and document offset resistance.

The toner of the present invention may be obtained by any known method such as a kneading-pulverizing method, a phase-inversion emulsification method, or a polymerization method.

For example, the toner can be produced by the kneading-pulverizing method as follows: components of the toner excluding a fluidizer are dry-blended, melt-kneaded, coarsely pulverized, and ultimately pulverized into fine particles using a jet mill or the like; and these particles are further classified to obtain fine particles having a volume average particle size (D50) of preferably 5 to 20 μm, followed by mixing with the fluidizer.

The volume average particle size (D50) is measured using a Coulter counter (e.g., product name: Multisizer III, available from Beckman Coulter, Inc.).

Alternatively, the toner can be produced by the phase-inversion emulsification method as follows: components of the toner excluding a fluidizer are dissolved or dispersed in an organic solvent; and the solution or dispersion is formed into an emulsion by, for example, adding water, followed by separation and classification. The volume average particle size of the toner is preferably 3 to 15 μm.

The toner of the present invention is used as a developer for electric latent images by being mixed with, if necessary, carrier particles, such as iron powder, glass beads, nickel powder, ferrite, magnetite, or resin (e.g., acrylic resin or silicone resin)-coated ferrite. The weight ratio of the toner to the carrier particles, if used, is preferably 1/99 to 99/1. Electric latent images can also be formed by friction with a member such as a charging blade instead of the carrier particles.

The toner of the present invention may not contain carrier particles.

The toner of the present invention is used as a recording material by being fixed to a support (e.g., paper or polyester film) by using a copier, a printer, or the like. The toner can be fixed to a support by a known method such as a heat roll fixing method or a flash fixing method.

The toner and toner binder of the present invention are used for developing electrostatic images or magnetic latent images by methods such as an electrophotographic method, an electrostatic recording method, or an electrostatic printing method. More specifically, the toner and toner binder are used for developing electrostatic images or magnetic latent images, particularly suitable for full color images.

EXAMPLES

The present invention is further described below with reference to examples and comparative examples, but the present invention is not limited thereto. Hereinafter, "part(s)" means part(s) by weight unless otherwise specified.

Production Example 1

Production of Polyester (A11-1)

A reaction vessel equipped with a condenser, a stirrer, and a nitrogen inlet was charged with 741 parts of a bisphenol A-EO (2.0 mol) adduct and 13 parts of trimethylolpropane as the saturated alcohol components (x), 119 parts of terephthalic acid and 120 parts of adipic acid as the saturated carboxylic acid components (w), and 2.5 parts of titaniumdiisopropoxybis(triethanolaminate) as a catalyst. They were reacted at 230° C. for two hours under a nitrogen stream while generated water was removed. The reaction was continued for additional five hours at a reduced pressure of 0.5 to 2.5 kPa, followed by cooling to 180° C. Then, 1 part of tert-butyl catechol as a polymerization inhibitor and 86 parts of fumaric acid as the unsaturated carboxylic acid component (y) were added, and the reaction was continued at a reduced pressure of 0.5 to 2.5 kPa for additional eight hours before the reaction product was taken out. Thus, a polyester (A11-1) was obtained.

The polyester (A11-1) had a glass transition temperature of 37° C., a peak top molecular weight of 11000, an acid value of 3 mg KOH/g, and a double bond content of 0.69 mmol/g as measured by the methods described above.

Production Examples 2 to 8

Production of Polyesters (A11-2) to (A11-8)

Polyesters (A11-2) to (A11-8) were each obtained by a reaction as in Production Example 1, except that in each production example, a reaction vessel equipped with a condenser, a stirrer, and a nitrogen inlet was charged with the alcohol components (x), saturated carboxylic acid components (w), and unsaturated carboxylic acid components (y) according to Table 1. Table 1 shows the glass transition temperature, peak top molecular weight, acid value, and double bond content of the obtained polyesters (A11-2) to (A11-8).

Comparative Production Example 1

Production of Polyester (A11'-1)

A polyester (A11'-1) having no carbon-carbon double bond was obtained by a reaction as in Production Example 1, except that a reaction vessel equipped with a condenser, a stirrer, and a nitrogen inlet was charged with the alcohol components (x) and saturated carboxylic acid components (w) according to Table 1. Table 1 shows the glass transition temperature, peak top molecular weight, acid value, and double bond content of the obtained polyester (A11'-1).

Comparative Production Example 2

Production of Polyester (A11'-2)

A reaction vessel equipped with a condenser, a stirrer, and a nitrogen inlet was charged with 710 parts of propylene glycol as the saturated alcohol component (x), 775 parts of terephthalic acid as the saturated carboxylic acid component (w), and 0.6 parts of titaniumdiisopropoxybis(triethanolaminate) as a catalyst. They were reacted at 220° C. for four hours under a nitrogen stream while generated water and excess propylene glycol were removed. The reaction was continued for additional 10 hours at a reduced pressure of 0.5 to 2.5 kPa before the reaction product was taken out. Thus, a polyester (A11'-2) having no carbon-carbon double bond was obtained. Here, 325 parts of unreacted propylene glycol was recovered (the propylene glycol content shown in Table 1 is thus 385 parts). Table 1 shows the glass transition temperature, peak top molecular weight, acid value, and double bond content of the obtained polyester (A11'-2).

TABLE 1

| Polyester (A11) | | | Production Example 1 (A11-1) | Production Example 2 (A11-2) | Production Example 3 (A11-3) | Production Example 4 (A11-4) | Production Example 5 (A11-5) | Production Example 6 (A11-6) |
|---|---|---|---|---|---|---|---|---|
| Composition (parts by weight) | Saturated carboxylic acid component (w) | Terephthalic acid | 119 | 132 | 413 | 273 | 192 | 153 |
| | | Adipic acid | 120 | 142 | 81 | — | 123 | 118 |
| | | Trimellitic anhydraide | — | — | — | — | — | — |
| | Unsaturated carboxylic acid component (y) | Fumaric acid | 86 | 48 | 128 | 48 | 19 | — |
| | | Acrylic acid | — | — | — | — | — | 40 |
| | | Dodecenylsuccinic anhydride | — | — | — | — | — | — |
| | Saturated alcohol component (x) | Bisphenol A-EO (2 mol) adduct | 741 | 733 | — | 739 | 729 | 755 |
| | | 3-Methyl-1,5-pentanediol | — | — | 489 | — | — | — |
| | | Trimethylolpropane | 13 | 21 | 32 | 8 | 12 | 13 |
| | | Bisphenol A-PO (2 mol) adduct | — | — | — | — | — | — |
| | | Propylene glycol | — | — | — | — | — | — |
| | Total (parts by weight) | | 1079 | 1076 | 1143 | 1068 | 1075 | 1079 |

TABLE 1-continued

| | | | | | | | |
|---|---|---|---|---|---|---|---|
| Properties | Glass transition temperature (° C.) | 37 | 35 | −25 | 48 | 44 | 25 |
| | Peak top molecular weight Mp | 11,000 | 10,500 | 7,000 | 15,000 | 12,000 | 8,500 |
| | Acid value (mg KOH/g) | 3 | 1 | 1 | 2 | 5 | 2 |
| | Double bond content (mmol/g) | 0.69 | 0.38 | 0.96 | 0.39 | 0.15 | 0.51 |

| Polyester (A11) | | | Production Example 7 (A11-7) | Production Example 8 (A11-8) | Comparative Production Example 1 (A11'-1) | Comparative Production Example 2 (A11'-2) |
|---|---|---|---|---|---|---|
| Composition (parts by weight) | Saturated carboxylic acid component (w) | Terephthalic acid | 100 | 112 | 288 | 775 |
| | | Adipic acid | 95 | 106 | 65 | — |
| | | Trimellitic anhydraide | — | — | 34 | — |
| | Unsaturated carboxylic acid component (y) | Fumaric acid | — | 81 | — | — |
| | | Acrylic acid | — | — | — | — |
| | | Dodecenylsuccinic anhydride | 166 | — | — | — |
| | Saturated alcohol component (x) | Bisphenol A-EO (2 mol) adduct | 675 | 755 | — | — |
| | | 3-Methyl-1,5-pentanediol | — | — | 61 | — |
| | | Trimethylolpropane | 13 | 14 | 20 | — |
| | | Bisphenol A-PO (2 mol) adduct | — | — | 604 | — |
| | | Propylene glycol | — | — | — | 385 |
| | Total (parts by weight) | | 1049 | 1068 | 1072 | 1160 |
| Properties | Glass transition temperature (° C.) | | 28 | 35 | 15 | 70 |
| | Peak top molecular weight Mp | | 9,500 | 8,500 | 10,000 | 7,000 |
| | Acid value (mg KOH/g) | | 1 | 1 | 1 | 2 |
| | Double bond content (mmol/g) | | 0.60 | 0.65 | 0.00 | 0.00 |

Production Example 9

Production of Vinyl Resin (B-1)

An autoclave was charged with 138 parts of xylene, purged with nitrogen, and heated to 170° C. in a sealed state under stirring. While the internal temperature of the autoclave was controlled to stay at 170° C., a mixture solution of the following components was dropped to the autoclave over three hours for polymerization: 450 parts of behenyl acrylate (hereinafter abbreviated as "C22 acrylate", available from NOF Corporation, the same hereinafter), 150 parts of styrene (available from Idemitsu Kosan Co., Ltd., the same hereinafter), 150 parts of acrylonitrile (available from Nacalai Tesque, Inc., the same hereinafter), 1.5 parts of di-t-butyl peroxide (PERBUTYL D, available from NOF Corporation, the same hereinafter), and 100 parts of xylene. After the dropping, the drop line was washed with 12 parts of xylene. The mixture was kept at the same temperature for four hours to complete polymerization. Desolvation was performed at 100° C. for three hours at a reduced pressure of 0.5 to 2.5 kPa. Thus, a vinyl resin (B-1) was obtained. Table 2 shows its composition.

The vinyl resin (B-1) had an endothermic peak top temperature of 60° C., an acid value of 0 mg KOH/g, a weight average molecular weight of 14000, and a $|SP(x)-SP(a)|$ of 3.6 $(cal/cm^3)^{0.5}$ as measured by the methods described above.

Production Example 10

Production of Vinyl Resin (B-2)

A vinyl resin (B-2) was obtained by a reaction as in Production Example 9, except that an autoclave was charged with 138 parts of xylene, purged with nitrogen, and heated to 170° C. in a sealed state under stirring, and that the materials shown in Table 2 together with 100 parts of xylene were dropped to the autoclave. Table 2 shows the endothermic peak top temperature, acid value, weight average molecular weight, and $|SP(x)-SP(a)|$ of the obtained vinyl resin (B-2).

The stearyl acrylate (a-2) was stearyl acrylate (octadecyl acrylate) available from Kyoeisha Chemical Co., Ltd. In Table 2, it is abbreviated as "C18 acrylate".

Production Example 11

Production of Vinyl Resin (B-3)

An autoclave was charged with 470 parts of toluene, purged with nitrogen, and heated to 105° C. in a sealed state under stirring. While the internal temperature of the autoclave was controlled to stay at 105° C., a mixture solution of the following components was dropped to the autoclave over two hours for polymerization: 500 parts of C22 acrylate, 250 parts of styrene, 250 parts of acrylonitrile, 20 parts of methacrylic acid (available from Tokyo Chemical Industry Co., Ltd.), 5 parts of sodium alkylallylsulfosuccinate (Eleminol JS-2, available from Sanyo Chemical Industries, Ltd.), 19 parts of 2-isocyanatoethyl methacrylate (Karenz MOI, available from Showa Denko K.K), 3.7 parts of t-butyl peroxy-2-ethylhexanoate (PERBUTYL O, available from NOF Corporation), and 240 parts of toluene. The mixture was kept at the same temperature for four hours to complete polymerization. Then, 16 parts of dinormalbutylamine and 5 parts of a bismuth catalyst (Neostann U-600, available from Nitto Kasei Co., Ltd.) were added for reaction at 90° C. for 6 hours, followed by desolvation at 100° C. Thus, a vinyl resin (B-3) was obtained. Table 2 shows the endothermic peak top temperature, acid value, weight average molecular weight, and |SP(x)−SP(a)| of the obtained vinyl resin (B-3).

Production Example 12

Synthesis of Triacontaacrylate

A reaction container equipped with a stirrer, a heating and cooling device, a thermometer, an air inlet, a pressure reducing device, and a water reducer was charged with 50 parts of 1-triacontanol (available from Tokyo Chemical Industry Co., Ltd.), 50 parts of toluene, 12 parts of acrylic acid (available from Mitsubishi Chemical Corporation), and 0.05 parts of hydroquinone. They were stirred to be homogenized. Then, 2 parts of paratoluenesulfonic acid was added, followed by stirring for 30 minutes. The mixture was reacted at 100° C. for five hours while air was blown into it at a flow rate of 30 mL/min and while generated water was removed. Thereafter, the internal pressure of the reaction container was adjusted to 300 mmHg, and the reaction was continued for additional three hours while generated water was removed. The reaction solution was cooled to room temperature, and 30 parts of a 10% by weight aqueous sodium hydroxide solution was added, followed by stirring for one hour. The reaction solution was then left to stand to separate the organic phase and the aqueous phase. The organic phase was recovered by separation and centrifugation operations. Then, 0.01 parts of hydroquinone was added to the organic phase, and while air was blown into it, the solvent was removed by pressure reduction. Thus, triacontaacrylate ("C30 acrylate" in Table 2) was obtained.

Production Examples 13 to 16 and Comparative Production Examples 3 and 4

Production of Vinyl Resins (B-4) to (B-7), (B'-1), and (B'-2)

Vinyl resins (B-4) to (B-7), (B'-1), and (B'-2) were each obtained by a reaction as in Production Example 9, except that in each production example, an autoclave was charged with 138 parts of xylene, purged with nitrogen, and heated to 170° C. in a sealed state under stirring, and that the materials shown in Table 2 together with 100 parts of xylene were dropped to the autoclave. Table 2 shows the endothermic peak top temperature, acid value, weight average molecular weight, and |SP(x)−SP(a)| of the obtained vinyl resins (B-4) to (B-7), (B'-1), and (B'-2). Since the vinyl resins (B'-1) and (B'-2) had a monomer (a) content of less than 15% by weight and thus did not correspond to the vinyl resin (B), their endothermic peak top temperatures were not measured.

The vinyl acetate (b-2) and butylacrylate (d-3) were as follows.

Vinyl acetate: a product available from Japan Vam & Poval Co., Ltd.

Butyl acrylate: a product available from Tokyo Chemical Industry Co., Ltd., "C4 acrylate" in Table 2.

TABLE 2

| Vinyl resin (B) | | | Production Example 9 (B-1) | Production Example 10 (B-2) | Production Example 11 (B-3) | Production Example 13 (B-4) | Production Example 14 (B-5) |
|---|---|---|---|---|---|---|---|
| Composition (parts by weight) | Monomer (a) | C22 acrylate (a-1) | 450 | — | 500 | — | 300 |
| | | C18 acrylate (a-2) | — | 525 | — | — | — |
| | | C30 acrylate (a-3) | — | — | — | 700 | — |
| | Monomer (b) | Acrylonitrile (b-1) | 150 | 75 | 250 | 100 | 200 |
| | | Vinyl acetate (b-2) | — | — | — | 200 | 500 |
| | | Methacrylic acid (b-3) | — | — | 20 | — | — |
| | Monomer (d) | Styrene (d-1) | 150 | 150 | 250 | — | — |
| | | Reaction product of 2-isocyanatoethyl methacrylate and dinormalbutylamine (d-2) | — | — | 35 | — | — |
| | | C4 acrylate (d-3) | — | — | — | — | — |
| | Other monomer | Sodium alkylallylsulfosuccinate | — | — | 5 | — | — |
| | Radical reaction initiator (c) | Di-t-butyl peroxide (c-1) | 1.5 | 0.3 | — | 0.8 | 0.2 |
| | | t-Butyl peroxy-2-ethylhexanoate (c-2) | — | — | 3.7 | — | — |
| Weight proportion of monomer (a) in monomers constituting vinyl resin (B) (% by weight) | | | 60 | 70 | 47 | 70 | 30 |
| Properties | Endothermic peak top temperature (° C.) | | 60 | 45 | 46 | 90 | 58 |
| | Acid value (mg KOH/g) | | 0 | 0 | 10 | 0 | 0 |
| | Weight average molecular weight | | 14,000 | 38,000 | 100,000 | 24,000 | 45,000 |
| | $\lvert SP(x) - SP(a)\rvert$ ($(cal/cm^3)^{0.5}$) | | 3.6 | 2.8 | 3.5 | 3.0 | 2.7 |

| Vinyl resin (B) | | | Production Example 15 (B-6) | Production Example 16 (B-7) | Comparative Production Example 3 (B'-1) | Comparative Production Example 4 (B'-2) |
|---|---|---|---|---|---|---|
| Composition (parts by weight) | Monomer (a) | C22 acrylate (a-1) | 950 | — | — | — |
| | | C18 acrylate (a-2) | — | — | — | 100 |
| | | C30 acrylate (a-3) | — | 150 | — | — |
| | Monomer (b) | Acrylonitrile (b-1) | 20 | 200 | — | 250 |
| | | Vinyl acetate (b-2) | — | 500 | — | 500 |
| | | Methacrylic acid (b-3) | — | — | — | — |

TABLE 2-continued

| | | | | | | |
|---|---|---|---|---|---|---|
| | Monomer (d) | Styrene (d-1) | 30 | 150 | 592 | 150 |
| | | Reaction product of 2-isocyanatoethyl methacrylate and dinormalbutylamine (d-2) | — | — | — | — |
| | | C4 acrylate (d-3) | — | — | 158 | — |
| | Other monomer | Sodium alkylallylsulfosuccinate | — | — | — | — |
| | Radical reaction initiator (c) | Di-t-butyl peroxide (c-1) | 1.0 | 0.5 | 2.0 | 0.6 |
| | | t-Butyl peroxy-2-ethylhexanoate (c-2) | — | — | — | — |
| | Weight proportion of monomer (a) in monomers constituting vinyl resin (B) (% by weight) | | 95 | 15 | 0 | 10 |
| Properties | Endothermic peak top temperature (° C.) | | 68 | 70 | — | — |
| | Acid value (mg KOH/g) | | 0 | 0 | 0 | 0 |
| | Weight average molecular weight | | 18,000 | 34,000 | 8,000 | 31,000 |
| | $\lvert SP(x) - SP(a)\rvert$ ($(cal/cm^3)^{0.5}$) | | 3.2 | 2.6 | — | 2.8 |

Example 1

Production of Toner Binder (C-1)

A mixture of 32 parts of the polyester (A11-1) and 68 parts of the vinyl resin (B-1) was fed into a twin-screw kneader (available from Kurimoto, Ltd., S5KRC kneader) at 52 kg/hour, and at the same time, 1.0 part of t-butylperoxyisopropyl monocarbonate (c-3) as the radical reaction initiator (c) was fed at 0.52 kg/hour to carry out a crosslinking reaction by kneading and extrusion at 160° C. for seven minutes at 90 rpm. The components were further mixed while the pressure was reduced to 10 kPa via the vent port to remove the organic solvent. The resulting mixture was cooled, whereby a toner binder (C-1) according to Example 1 was obtained.

Examples 2 to 12

Production of Toner Binders (C-2) to (C-12)

The polyester (A11) and the vinyl resin (B) in parts according to Table 3 were mixed and fed into a twin-screw kneader, and at the same time the radical reaction initiator (c) was fed thereinto to carry out a crosslinking reaction as in Example 1, and the organic solvent was removed as in Example 1. Thus, toner binders (C-2) to (C-12) according to Examples 2 to 12 were obtained.

The radical reaction initiators (c) in Table 2 and Table 3 were as follows.

(c-1): Di-t-butyl peroxide
(c-2): t-Butyl peroxy-2-ethylhexanoate
(c-3): t-Butyl peroxyisopropylmonocarbonate
(c-4): t-Butyl peroxybenzoate

Comparative Examples 1 to 5

Production of Toner Binders (C'-1) to (C'-5)

The polyester (A11) or (A11') and the vinyl resin (B) or vinyl resin (B') in parts according to Table 3 were mixed and fed into a twin-screw kneader as in Example 1, and at the same time the radical reaction initiator (c) was fed thereinto to carry out a crosslinking reaction as in Example 1. Thus, toner binders (C'-1) to (C'-5) according to Comparative Examples 1 to 5 were obtained.

TABLE 3

| | Toner binder (C) | | Example 1 (C-1) | Example 2 (C-2) | Example 3 (C-3) | Example 4 (C-4) | Example 5 (C-5) | Example 6 (C-6) | Example 7 (C-7) |
|---|---|---|---|---|---|---|---|---|---|
| Composition (parts by weight) | Polyester (A11) | (A11-1) | 32 | — | — | 25 | — | — | — |
| | | (A11-2) | — | 23 | — | — | — | — | — |
| | | (A11-3) | — | — | 15 | — | — | — | 5 |
| | | (A11-4) | — | — | — | — | 25 | — | — |
| | | (A11-5) | — | — | — | — | — | 50 | — |
| | | (A11-6) | — | — | — | — | — | — | — |
| | | (A11-7) | — | — | — | — | — | — | — |
| | | (A11-8) | — | — | — | — | — | — | — |
| | | (A11'-1) | — | — | — | — | — | — | — |
| | | (A11'-2) | — | — | — | — | — | — | — |
| | Vinyl resin (B) | (B-1) | 68 | 77 | — | — | 75 | — | — |
| | | (B-2) | — | — | 85 | 75 | — | — | — |
| | | (B-3) | — | — | — | — | — | — | — |
| | | (B-4) | — | — | — | — | — | 50 | — |
| | | (B-5) | — | — | — | — | — | — | 95 |
| | | (B-6) | — | — | — | — | — | — | — |
| | | (B-7) | — | — | — | — | — | — | — |
| | | (B'-1) | — | — | — | — | — | — | — |
| | | (B'-2) | — | — | — | — | — | — | — |
| | Radical reaction initiator (c) | (c-1) | — | — | 1 | — | — | — | — |
| | | (c-3) | 1 | 1 | — | 1 | 1 | 1 | 1 |
| | | (c-4) | — | — | — | — | — | — | — |

TABLE 3-continued

| | | | | | | | | |
|---|---|---|---|---|---|---|---|---|
| Properties | Organic solvent content (ppm) | 300 | 400 | 200 | 350 | 400 | 1,200 | 80 |
| | Endothermic peak top temperature (° C.) | 58 | 59 | 44 | 43 | 59 | 89 | 57 |
| | Glass transition temperature ($Tg_T$) (° C.) | 37 | 35 | −26 | 36 | 48 | 44 | −24 |
| | THF insolubles (%) | 30 | 20 | 14 | 20 | 19 | 35 | 3 |
| | $In(G'_{Tm-10})/In(G'_{Tm+30})$ | 1.5 | 1.6 | 1.2 | 2.3 | 1.6 | 1.3 | 2.6 |

| | | | Example 8 (C-8) | Example 9 (C-9) | Example 10 (C-10) | Example 11 (C-11) | Example 12 (C-12) | Comparative Example 1 (C'-1) |
|---|---|---|---|---|---|---|---|---|
| | Toner binder (C) | | | | | | | |
| Composition (parts by weight) | Polyester (A11) | (A11-1) | — | — | — | — | — | — |
| | | (A11-2) | — | — | — | — | — | — |
| | | (A11-3) | — | — | — | — | — | — |
| | | (A11-4) | — | — | — | — | — | — |
| | | (A11-5) | — | — | 80 | 30 | — | — |
| | | (A11-6) | 40 | — | — | — | — | — |
| | | (A11-7) | — | 20 | — | — | — | — |
| | | (A11-8) | — | — | — | — | 20 | — |
| | | (A11'-1) | — | — | — | — | — | 30 |
| | | (A11'-2) | — | — | — | — | — | — |
| | Vinyl resin (B) | (B-1) | — | — | — | — | — | 70 |
| | | (B-2) | — | — | — | — | — | — |
| | | (B-3) | — | — | — | — | — | — |
| | | (B-4) | — | — | — | — | — | — |
| | | (B-5) | — | 80 | — | 70 | — | — |
| | | (B-6) | 60 | — | 20 | — | — | — |
| | | (B-7) | — | — | — | — | 80 | — |
| | | (B'-1) | — | — | — | — | — | — |
| | | (B'-2) | — | — | — | — | — | — |
| | Radical reaction initiator (c) | (c-1) | — | — | — | — | — | 1 |
| | | (c-3) | 1 | 1 | 1 | 1 | 1 | — |
| | | (c-4) | — | — | — | — | — | — |
| Properties | Organic solvent content (ppm) | | 800 | 500 | 1,900 | 600 | 450 | 300 |
| | Endothermic peak top temperature (° C.) | | 66 | 56 | 65 | 56 | 67 | 58 |
| | Glass transition temperature ($Tg_T$) (° C.) | | 24 | 28 | 45 | 44 | 34 | 15 |
| | THF insolubles (%) | | 30 | 16 | 70 | 20 | 16 | 0 |
| | $In(G'_{Tm-10})/In(G'_{Tm+30})$ | | 1.6 | 2.2 | 1.0 | 2.1 | 1.3 | 2.7 |

| | | | Comparative Example 2 (C'-2) | Comparative Example 3 (C'-3) | Comparative Example 4 (C'-4) | Comparative Example 5 (C'-5) |
|---|---|---|---|---|---|---|
| Toner binder (C) | | | | | | |
| Composition (parts by weight) | Polyester (A11) | (A11-1) | 30 | — | — | 30 |
| | | (A11-2) | — | — | — | — |
| | | (A11-3) | — | — | — | — |
| | | (A11-4) | — | — | — | — |
| | | (A11-5) | — | — | — | — |
| | | (A11-6) | — | — | — | — |
| | | (A11-7) | — | — | — | — |
| | | (A11-8) | — | — | 25 | — |
| | | (A11'-1) | — | — | — | — |
| | | (A11'-2) | — | — | 75 | — |
| | Vinyl resin (B) | (B-1) | — | — | — | — |
| | | (B-2) | — | — | — | — |
| | | (B-3) | — | 100 | — | — |
| | | (B-4) | — | — | — | — |
| | | (B-5) | — | — | — | — |
| | | (B-6) | — | — | — | — |
| | | (B-7) | — | — | — | — |
| | | (B'-1) | 70 | — | — | — |
| | | (B'-2) | — | — | — | 70 |
| | Radical reaction initiator (c) | (c-1) | 1 | — | — | — |
| | | (c-3) | — | — | — | — |
| | | (c-4) | — | — | 1 | 1 |
| Properties | Organic solvent content (ppm) | | 400 | 200 | 1,800 | 900 |
| | Endothermic peak top temperature (° C.) | | — | 46 | — | — |
| | Glass transition temperature ($Tg_T$) (° C.) | | 53 | — | 58 | 36 |
| | THF insolubles (%) | | 27 | 0 | 22 | 26 |
| | $In(G'_{Tm-10})/In(G'_{Tm+30})$ | | — | 2.2 | — | — |

The toner binders according to the examples and comparative examples were subjected to measurements by the methods described above to determine the organic solvent content, the endothermic peak top temperature derived from the vinyl resin (B) (in Table 3, simply "Endothermic peak top temperature"), glass transition temperature, and THF insolubles. The storage modulus (G') of the toner binders at a temperature of (Tm−10°) C and a temperature of (Tm+30°) C was also measured and $\ln(G'_{Tm-10})/\ln(G'_{Tm+30})$ was calculated. The results are shown in Table 3. The toner binders of Examples 1 to 12 and Comparative Examples 1 and 3 each had only one endothermic peak derived from the vinyl resin (B). The endothermic peak top temperatures derived from the vinyl resins (B) determined by DSC analysis of the toner binders were confirmed to correspond to the endothermic peak top temperatures derived from the vinyl resins shown in Table 2.

In Comparative Examples 2, 4, and 5, the toner binders did not contain the vinyl resin (B). Thus, they did not show the endothermic peak top temperature (Tm) derived from the vinyl resin (B) nor $\ln(G'_{Tm-10})/\ln(G'_{Tm+30})$, which is obtained from the storage modulus (G') measured based on the endothermic peak top temperature (Tm) (in Table 2, Tm and $\ln(G'_{Tm-10})/\ln(G'_{Tm+30})$ of these comparative examples are indicated by "-"). In Comparative Example 3, the glass transition temperature was −35° C. or lower and thus indicated by "-"

Example 13

Production of Toner (T-1)

To 85 parts of the toner binder (C-1) according to Example 1 were added 8 parts of carbon black (available from Mitsubishi Chemical Corporation, MA-100) as a pigment, 4 parts of carnauba wax as a release agent, and 2 parts of a charge control agent (available from Hodogaya Chemical Co., Ltd., T-77). A toner was prepared by the following method.

First, the components were pre-mixed using a Henschel mixer (available from Nippon Coke and Engineering Co., Ltd., FM10B), and then kneaded by a twin-screw kneader (PCM-30 available from Ikegai Corporation). Subsequently, after the kneaded mixture was finely pulverized with a supersonic jet pulverizer "Labo Jet" (available from Kurimoto, Ltd., KJ-25), the resultant particles were classified by Elbow-Jet Air Classifier (available from MATSUBO Corporation, EJ-L-3 (LABO) model) to give toner particles having an volume average particle size D50 of 8 μm.

Subsequently, 1 part of colloidal silica (available from Nippon Aerosil. Co., Ltd., Aerosil R972) as a fluidizer was added to 100 parts of the toner particles and mixed in a sample mill. Thus, a toner (T-1) according to Example 13 was obtained.

Examples 14 to 24

Production of Toners (T-2) to (T-12)

Toners were produced as in Example 13 using materials in parts according to Table 4, whereby toners (T-2) to (T-12) according to Examples 14 to 24 were obtained.

Comparative Examples 6 to 10

Production of Toners (T'-1) to (T'-5)

Toners were produced as in Example 13 using materials in parts according to Table 4, whereby toners (T'-1) to (T'-5) according to Comparative Example 6 to 10 were obtained.

[Evaluation Method]

The following describes measurement methods, evaluation methods, and criteria for testing each of the obtained toners (T-1) to (T-12) and (T'-1) to (T'-5) for low-temperature fixability, hot offset resistance, image strength, heat-resistant storage stability, electrostatic charge stability, gloss, durability, and pulverizability.

<Low-Temperature Fixability>

The toner was uniformly placed on paper to a weight per unit area of 1.00 mg/cm$^2$. Here, the powder was placed on the paper using a printer with its thermal fixing device removed.

This paper was passed between a soft roller and a heating roller at a fixing rate (peripheral speed of the heating roller) of 213 mm/sec with the heating roller temperature in increments of 5° C. in the range of 90° C. to 200° C.

Then, the toner-fixed image was visually observed for occurrence of cold offset, and the cold offset occurrence temperature (MFT) was measured.

A lower cold offset occurrence temperature indicates better low-temperature fixability.

Under the above evaluation conditions, usually, a MFT of 125° C. or lower is preferred.

<Hot Offset Resistance>

By the same method as described above for the low-temperature fixability, the toner was placed on paper, which was passed between a soft roller and a heating roller at a fixing rate (peripheral speed of the heating roller) of 213 mm/sec with the heating roller temperature in increments of 5° C. in the range of 90° C. to 200° C.

Then, the toner-fixed image was visually observed for occurrence of hot offset, and the hot offset occurrence temperature was measured.

A higher hot offset occurrence temperature indicates better hot offset resistance. Under the above evaluation conditions, a hot offset occurrence temperature of 180° C. or higher is preferred.

<Image Strength>

The image fixed for the evaluation of the low-temperature fixability was subjected to a scratch test under a load of 10 g that was applied to a pencil fixed at an inclination of 45 degrees from directly above the pencil according to JIS K 5600-5-4 (1999). The image strength was evaluated based on the hardness of the pencil that did not scratch the image. A higher pencil hardness indicates better image strength. Generally, a hardness of B or higher is preferred.

<Heat-Resistant Storage Stability>

The toner (1 g) was placed in an airtight container and left to stand in an atmosphere of 50° C. and a humidity of 50% for 24 hours. The degree of blocking was visually observed, and the heat-resistant storage stability was evaluated according to the following criteria.

[Criteria]

Good: No blocking occurred, indicating excellent heat-resistant storage stability.

Fair: Blocking occurred partially, indicating low heat-resistant storage stability.

Poor: Blocking occurred entirely, indicating very low heat-resistant storage stability.

<Electrostatic Charge Stability>

(1) A 50-mL glass jar was charged with 0.5 g of the toner and 20 g of a ferrite carrier (available from Powdertech Co., Ltd., F-150). The temperature and the relative humidity inside the glass jar were controlled at 23° C. and 50% for at least eight hours.

(2) The glass jar was friction-stirred at 50 rpm for 10 minutes and for 60 minutes by a Turbula shaker-mixer. The electrostatic charge level was measured for each time period.

A blow-off electrostatic charge level measurement device (available from Kyocera Chemical Corporation) was used for the measurement.

A value of "electrostatic charge level after a friction time of 60 minutes/electrostatic charge level after a friction time of 10 minutes" was calculated to obtain an electrostatic charge stability index.

A greater electrostatic charge stability index indicates better electrostatic charge stability. Under the above evaluation conditions, an electrostatic charge stability index of 0.7 or greater is preferred.

<Gloss>

The toner was placed on paper and fixed to the paper by the same method as described above for the low-temperature fixability.

Then, thick white paper was placed under the toner-fixed paper, and the gloss degree (%) of the printed image was measured at an incident angle of 60 degrees using a gloss-meter ("IG-330" available from Horiba, Ltd.) for each increment of 5° C. in the range of the cold offset occurrence temperature (MFT) to a hot offset occurrence temperature. The highest gloss degree (maximum gloss degree) (%) in the range is used as an index of the gloss of the toner.

For example, when the gloss degree is 10% at 120° C., 15% at 125° C., 20% at 130° C., and 18% at 135° C., the highest gloss degree is 20% at 130° C. Thus, the gloss degree of 20% is used as an index.

A higher gloss degree indicates better gloss. Under the above evaluation conditions, a gloss degree of 10% or higher is preferred.

<Durability>

Using the toner as a two-component developer, copies were continuously made with a commercially available monochrome copying machine (available from Sharp Corporation, AR5030). The durability was evaluated according to the following criteria.

[Criteria]

Very good: No image quality change or fogging occurred even after 10000 copies were made.

Good: Fogging occurred after 10000 copies were made.

Fair: Fogging occurred after 6000 copies were made.

Poor: Fogging occurred after 2000 copies were made.

<Pulverizability>

To 85 parts of each toner binder used for the toners (T-1) to (T-11) and (T'-1) to (T'-4) were added 8 parts of carbon black (available from Mitsubishi Chemical Corporation, MA-100) as a pigment, 4 parts of carnauba wax as a release agent, and 2 parts of a charge control agent (available from Hodogaya Chemical Co., Ltd., T-77). The components were pre-mixed using a Henschel mixer (available from Nippon Coke and Engineering Co., Ltd., FM10B), and then kneaded by a twin-screw kneader (available from Ikegai Corporation, PCM-30). The mixture obtained by kneading was cooled, pulverized, and classified. Particles with a size that passed through 8.6 mesh and was retained on 30 mesh were used as particles for pulverizability evaluation. The particles for pulverizability evaluation were finely pulverized with a supersonic jet pulverizer "Labo Jet" (available from Kurimoto, Ltd., KJ-25) under the following conditions.

Pulverizing pressure: 0.64 MPa

Pulverizing time: 15 minutes

Separator frequency: 150 Hz

Adjuster ring: 15 mm

Louver size: medium

The pulverized product was directly used as particles for pulverizability evaluation without classification. The volume average particle size (μm) thereof was measured with a Coulter counter (product name Multisizer III, available from Beckman Coulter, Inc).

A smaller volume average particle size indicates better pulverizability. Under the above evaluation conditions, a volume average particle size of 8.0 μm or smaller is preferred.

TABLE 4

| | | Toner | | Example 13 (T-1) | Example 14 (T-2) | Example 15 (T-3) | Example 16 (T-4) | Example 17 (T-5) | Example 18 (T-6) |
|---|---|---|---|---|---|---|---|---|---|
| Toner (T) | Composition (parts by weight) | Toner binder | (C-1) | 85 | — | — | — | — | — |
| | | | (C-2) | — | 85 | — | — | — | — |
| | | | (C-3) | — | — | 85 | — | — | — |
| | | | (C-4) | — | — | — | 85 | — | — |
| | | | (C-5) | — | — | — | — | 85 | — |
| | | | (C-6) | — | — | — | — | — | 85 |
| | | | (C-7) | — | — | — | — | — | — |
| | | | (C-6) | — | — | — | — | — | — |
| | | | (C-9) | — | — | — | — | — | — |
| | | | (C-10) | — | — | — | — | — | — |
| | | | (C-11) | — | — | — | — | — | — |
| | | | (C-12) | — | — | — | — | — | — |
| | | | (C'-1) | — | — | — | — | — | — |
| | | | (C'-2) | — | — | — | — | — | — |
| | | | (C'-3) | — | — | — | — | — | — |
| | | | (C'-4) | — | — | — | — | — | — |
| | | | (C'-5) | — | — | — | — | — | — |
| | | Pigment | Cartoon black MA-100 | 8 | 8 | 8 | 8 | 8 | 8 |
| | | Charge control agent | T-77 | 2 | 2 | 2 | 2 | 2 | 2 |
| | | Release agent | Carnauba wax | 4 | 4 | 4 | 4 | 4 | 4 |
| | | Fluidizer | Aerosil R972 | 1 | 1 | 1 | 1 | 1 | 1 |

TABLE 4-continued

| | | | | | | | | |
|---|---|---|---|---|---|---|---|---|
| Performance evaluation | Low-temperature fixability | Cold offset occurrence temperature (° C.) | 105 | 100 | 100 | 95 | 120 | 125 |
| | Hot offset resistance | Hot offset occurrence temperature (° C.) | 190 | 180 | 200 | 180 | 180 | 200 |
| | Image strength | Pencil hardness | H | H | HB | H | H | 2H |
| | Heat-resistant storage stability | Heat-resistant storage stability evaluation | Good | Good | Good | Good | Good | Good |
| | Electrostatic charge stability | Electrostatic charge stability index | 0.8 | 0.8 | 0.8 | 0.8 | 0.8 | 0.9 |
| | Gloss | Maximum gloss degree | 18% | 15% | 16% | 20% | 21% | 15% |
| | Durability | Durability evaluation | Very good | Very good | Very good | Very good | Very good | Very good |
| | Pulverizability | Volume average particle size of finely pulverized product (μm) | 7.0 | 6.3 | 7.4 | 6.6 | 6.1 | 7.0 |

| | | Toner | | Example 19 (T-7) | Example 20 (T-8) | Example 21 (T-9) | Example 22 (T-10) | Example 23 (T-11) | Example 24 (T-12) |
|---|---|---|---|---|---|---|---|---|---|
| Toner (T) | Composition (parts by weight) | Toner binder | (C-1) | — | — | — | — | — | — |
| | | | (C-2) | — | — | — | — | — | — |
| | | | (C-3) | — | — | — | — | — | — |
| | | | (C-4) | — | — | — | — | — | — |
| | | | (C-5) | — | — | — | — | — | — |
| | | | (C-6) | — | — | — | — | — | — |
| | | | (C-7) | 85 | — | — | — | — | — |
| | | | (C-6) | — | 85 | — | — | — | — |
| | | | (C-9) | — | — | 85 | — | — | — |
| | | | (C-10) | — | — | — | 85 | — | — |
| | | | (C-11) | — | — | — | — | 85 | — |
| | | | (C-12) | — | — | — | — | — | 85 |
| | | | (C'-1) | — | — | — | — | — | — |
| | | | (C'-2) | — | — | — | — | — | — |
| | | | (C'-3) | — | — | — | — | — | — |
| | | | (C'-4) | — | — | — | — | — | — |
| | | | (C'-5) | — | — | — | — | — | — |
| | | Pigment | Cartoon black MA-100 | 8 | 8 | 8 | 8 | 8 | 8 |
| | | Charge control agent | T-77 | 2 | 2 | 2 | 2 | 2 | 2 |
| | | Release agent | Carnauba wax | 4 | 4 | 4 | 4 | 4 | 4 |
| | | Fluidizer | Aerosil R972 | 1 | 1 | 1 | 1 | 1 | 1 |
| Performance evaluation | Low-temperature fixability | Cold offset occurrence temperature (° C.) | | 90 | 90 | 110 | 125 | 100 | 125 |
| | Hot offset resistance | Hot offset occurrence temperature (° C.) | | 180 | 200 | 190 | 200 | 190 | 200 |
| | Image strength | Pencil hardness | | B | H | HB | 2H | H | 2H |
| | Heat-resistant storage stability | Heat-resistant storage stability evaluation | | Good | Good | Good | Good | Good | Good |
| | Electrostatic charge stability | Electrostatic charge stability index | | 0.7 | 0.9 | 0.8 | 0.9 | 0.8 | 0.9 |
| | Gloss | Maximum gloss degree | | 27% | 17% | 20% | 10% | 17% | 23% |
| | Durability | Durability evaluation | | Good | Very good | Very good | Very good | Very good | Very good |
| | Pulverizability | Volume average particle size of finely pulverized product (μm) | | 6.0 | 6.6 | 7.1 | 8.0 | 7.2 | 6.9 |

| | | Toner | | Comparative Example 6 (T'-1) | Comparative Exarrple 7 (T'-2) | Comparative Example 8 (T'-3) |
|---|---|---|---|---|---|---|
| Toner (T) | Composition (parts by weight) | Toner binder | (C-1) | — | — | — |
| | | | (C-2) | — | — | — |
| | | | (C-3) | — | — | — |
| | | | (C-4) | — | — | — |
| | | | (C-5) | — | — | — |
| | | | (C-6) | — | — | — |
| | | | (C-7) | — | — | — |
| | | | (C-6) | — | — | — |
| | | | (C-9) | — | — | — |
| | | | (C-10) | — | — | — |
| | | | (C-11) | — | — | — |
| | | | (C-12) | — | — | — |
| | | | (C'-1) | 85 | — | — |
| | | | (C'-2) | — | 85 | — |
| | | | (C'-3) | — | — | 85 |
| | | | (C'-4) | — | — | — |
| | | | (C'-5) | — | — | — |
| | | Pigment | Cartoon black MA-100 | 8 | 8 | 8 |
| | | Charge control agent | T-77 | 2 | 2 | 2 |
| | | Release agent | Carnauba wax | 4 | 4 | 4 |
| | | Fluidizer | Aerosil R972 | 1 | 1 | 1 |

TABLE 4-continued

| | | | | | |
|---|---|---|---|---|---|
| Performance evaluation | Low-temperature fixability | Cold offset occurrence temperature (° C.) | 130 | 155 | 90 |
| | Hot offset resistance | Hot offset occurrence temperature (° C.) | 150 | 190 | 180 |
| | Image strength | Pencil hardness | 2B | B | HB |
| | Heat-resistant storage stability | Heat-resistant storage stability evaluation | Poor | Good | Good |
| | Electrostatic charge stability | Electrostatic charge stability index | 0.7 | 0.8 | 0.8 |
| | Gloss | Maximum gloss degree | 10% | 8% | 20% |
| | Durability | Durability evaluation | Very good | Very good | Fair |
| | Pulverizability | Volume average particle size of finely pulverized product (μm) | 6.4 | 6.8 | 9.5 |

| | | | | Toner | Comparative Example 9 (T'-4) | Comparative Example 10 (T'-5) |
|---|---|---|---|---|---|---|
| Toner (T) | Composition (parts by weight) | Toner binder | (C-1) | | — | — |
| | | | (C-2) | | — | — |
| | | | (C-3) | | — | — |
| | | | (C-4) | | — | — |
| | | | (C-5) | | — | — |
| | | | (C-6) | | — | — |
| | | | (C-7) | | — | — |
| | | | (C-6) | | — | — |
| | | | (C-9) | | — | — |
| | | | (C-10) | | — | — |
| | | | (C-11) | | — | — |
| | | | (C-12) | | — | — |
| | | | (C'-1) | | — | — |
| | | | (C'-2) | | — | — |
| | | | (C'-3) | | — | — |
| | | | (C'-4) | | 85 | — |
| | | | (C'-5) | | — | 85 |
| | | Pigment | Cartoon black MA-100 | | 8 | 8 |
| | | Charge control agent | T-77 | | 2 | 2 |
| | | Release agent | Carnauba wax | | 4 | 4 |
| | | Fluidizer | Aerosil R972 | | 1 | 1 |
| Performance evaluation | Low-temperature fixability | Cold offset occurrence temperature (° C.) | | | 110 | 140 |
| | Hot offset resistance | Hot offset occurrence temperature (° C.) | | | 190 | 200 |
| | Image strength | Pencil hardness | | | H | H |
| | Heat-resistant storage stability | Heat-resistant storage stability evaluation | | | Good | Poor |
| | Electrostatic charge stability | Electrostatic charge stability index | | | 0.8 | 0.8 |
| | Gloss | Maximum gloss degree | | | 18% | 15% |
| | Durability | Durability evaluation | | | Fair | Fair |
| | Pulverizability | Volume average particle size of finely pulverized product (μm) | | | 6.1 | 6.7 |

The evaluation results in Table 4 clearly indicate that the toners (T-1) to (T-12) according to Examples 13 to 24 showed excellent results in all the performance evaluations.

The toners (T'-1) to (T'-5) according to Comparative Examples 6 to 10 showed poor results in some performance items.

INDUSTRIAL APPLICABILITY

The toner binder and toner of the present invention maintain low-temperature fixability and offset resistance while having excellent pulverizability, image strength, heat-resistant storage stability, electrostatic charge stability, gloss, and durability, and can be suitably used as a toner binder and a toner for developing electrostatic images in electrophotography, electrostatic recording, and electrostatic printing.

The toner and toner binder are also suitable for applications such as additives for coating materials, additives for adhesive, and particles for electric paper.

The invention claimed is:

1. A toner binder comprising:

a polyester resin (A); and a vinyl resin (B), wherein the polyester resin (A) is a resin obtained by crosslinking a polyester (A1) by one or more carbon-carbon bonds, the vinyl resin (B) is a polymer containing a monomer (a) as an essential constituent monomer, the monomer (a) is a C21-C40 (meth)acrylate having an acyclic hydrocarbon group, and the weight proportion of the monomer (a) in monomers constituting the vinyl resin (B) is 15 to 99% by weight based on the weight of the vinyl resin (B).

2. The toner binder according to claim 1, wherein the polyester (A1) is a polyester (A11) having carbon-carbon double bonds.

3. The toner binder according to claim 2, wherein the polyester (A11) having carbon-carbon double bonds has a double bond content of 0.02 to 2.00 mmol/g based on the weight of the polyester (A11).

4. The toner binder according to claim 1, wherein the polyester (A1) has a glass transition temperature ($Tg_{A1}$) of −35° C. to 45° C.

5. The toner binder according to claim 1, wherein the toner binder has an organic solvent content of 50 ppm or more and 2000 ppm or less.

6. The toner binder according to claim 1, wherein the weight ratio ((A1)/(B)) of the polyester (A1) to the vinyl resin (B) is 5/95 to 50/50.

7. The toner binder according to claim 1, wherein the vinyl resin (B) is a polymer further containing a monomer (b) having a vinyl group and having a carbon number of 6 or less as an essential constituent monomer.

8. The toner binder according to claim 1, wherein when the toner binder is analyzed by differential scanning calorimetry in which the toner binder is held at 30° C. for 10 minutes, heated from 30° C. to 150° C. at 10° C./min by first heating, then held at 150° C. for 10 minutes, subsequently cooled to 0° C. at 10° C./min, then held at 0° C. for 10 minutes, and then heated from 0° C. to 150° C. at 10° C./min by second heating, the toner binder has at least one endothermic peak top temperature (Tm) derived from the vinyl resin (B) in the range of 40° C. to 100° C. on a differential scanning calorimetry curve obtained in the second heating, and satisfies relation (1):

$$2 \leq \ln(G'_{Tm-10})/\ln(G'_{Tm+30}) \leq 2.6$$

wherein $G'_{Tm-10}$ is the storage modulus (Pa) of the toner binder at a temperature of (Tm−10)° C. and $G'_{Tm+30}$ is the storage modulus (Pa) of the toner binder at a temperature of (Tm+30)° C.

9. A toner comprising the toner binder according to claim 1.

* * * * *